US012709946B2

(12) United States Patent
Cowart et al.

(10) Patent No.: US 12,709,946 B2
(45) Date of Patent: Aug. 18, 2026

(54) FIXED CUTTER DRILL BITS WITH MECHANICALLY ATTACHED CUTTER ELEMENT ASSEMBLIES

(71) Applicant: Grant Prideco, Inc., Houston, TX (US)

(72) Inventors: Russell W. Cowart, Conroe, TX (US); David P. Miess, Magnolia, TX (US); Cesar E. Hernandez, Conroe, TX (US); Tom S. Roberts, Montgomery, TX (US)

(73) Assignee: GRANT PRIDECO, INC., Houston, TX (US)

( * ) Notice: Subject to any disclaimer, the term of this patent is extended or adjusted under 35 U.S.C. 154(b) by 0 days.

(21) Appl. No.: 19/273,251

(22) Filed: Jul. 18, 2025

(65) Prior Publication Data

US 2026/0022611 A1 Jan. 22, 2026

Related U.S. Application Data

(60) Provisional application No. 63/673,761, filed on Jul. 21, 2024.

(51) Int. Cl.
*E21B 10/43* (2006.01)
*E21B 10/633* (2006.01)

(52) U.S. Cl.
CPC ..... *E21B 10/43* (2013.01); *E21B 10/633* (2013.01)

(58) Field of Classification Search
CPC ..... E21B 10/43; E21B 10/633
See application file for complete search history.

(56) References Cited

U.S. PATENT DOCUMENTS 10,975,627 B2 * 4/2021 Ling ..... E21B 10/54
11,649,682 B1 * 5/2023 Miess ..... E21B 10/5673 175/432

(Continued)

FOREIGN PATENT DOCUMENTS

WO 2024/044707 A1 2/2024

OTHER PUBLICATIONS

PCT/US2025/038198 International Search Report and Written Opinion dated Nov. 3, 2025 (3314-68202) (11 p.).

*Primary Examiner* — Shane Bomar
(74) *Attorney, Agent, or Firm* — CONLEY ROSE, P.C.

(57) ABSTRACT

A modular fixed cutter drill bit for drilling an earthen formation has a central axis and a cutting direction of rotation about the central axis. The drill bit includes a bit body configured to rotate about the central axis in the cutting direction of rotation. The bit body includes a bit face. In addition, the drill bit includes a blade extending radially along the bit face. The blade has a leading side relative to the cutting direction of rotation, a trailing side relative to the cutting direction of rotation, and a cutter-supporting surface extending from the leading side to the trailing side. The blade includes a socket extending from the leading side of the blade and penetrating the cutter-supporting surface of the blade. The socket has a central axis, an open end at the leading side of the blade, and a closed end distal the leading side of the blade. Further, the drill bit includes a cutter element assembly removably mounted to the blade and extending from the cutter-supporting surface of the blade. The cutter element assembly includes a pod seated in the socket and fixably attached to the blade. The pod has a central axis, a leading end positioned outside the socket, and a trailing end positioned in the socket. The pod includes a pocket extending from the leading end. The cutter element assembly also includes a cutter element disposed in the (Continued)

pocket. The pod is a split pod comprising a first pod section and a second pod section that are removably attached together to secure the cutter element within the pocket.

20 Claims, 10 Drawing Sheets

(56) References Cited

U.S. PATENT DOCUMENTS

| | | | | |
|---|---|---|---|---|
| 2010/0314176 | A1 | 12/2010 | Zhang et al. | |
| 2011/0297454 | A1* | 12/2011 | Shen | E21B 10/633 175/431 |
| 2014/0326515 | A1* | 11/2014 | Shi | E21B 10/633 76/108.4 |
| 2014/0360792 | A1 | 12/2014 | Azar et al. | |
| 2015/0330153 | A1* | 11/2015 | Miller | E21B 10/633 175/327 |
| 2016/0084010 | A1* | 3/2016 | Beaton | E21B 10/22 175/432 |
| 2017/0130534 | A1* | 5/2017 | Nguyen | E21B 10/633 |
| 2019/0145179 | A1 | 5/2019 | Schroder et al. | |

* cited by examiner

FIXED CUTTER DRILL BITS WITH MECHANICALLY ATTACHED CUTTER ELEMENT ASSEMBLIES

CROSS-REFERENCE TO RELATED APPLICATIONS

This application claims benefit of U.S. provisional patent application Ser. No. 63/673,761 filed Jul. 21, 2024, and entitled "Fixed Cutter Drill Bits with Mechanically Attached Cutter Element Assemblies," which is hereby incorporated herein by reference in its entirety for all purposes.

STATEMENT REGARDING FEDERALLY SPONSORED RESEARCH OR DEVELOPMENT

Not applicable.

FIELD

The present disclosure relates generally to earth-boring bits used to drill a borehole for the ultimate recovery of oil, gas or minerals. More particularly, the present disclosure relates to fixed cutter drill bits with mechanical attached cutter elements, as well as to methods of making and using the same.

BACKGROUND

An earth-boring drill bit is typically mounted on the lower end of a drill string and is rotated by rotating the drill string at the surface or by actuation of downhole motors or turbines, or by both methods. With weight applied to the drill string, the rotating drill bit engages the earthen formation and proceeds to form a borehole along a predetermined path toward a target zone. The borehole thus created has a diameter generally equal to the diameter or "gage" of the drill bit.

Fixed cutter bits, also known as rotary drag bits, are one type of drill bit commonly used to drill boreholes. Fixed cutter bit designs include a plurality of blades angularly spaced about a bit face. The blades generally project radially outward along the bit face and form flow channels therebetween. Cutter elements are typically grouped and mounted on the blades. The configuration or layout of the cutter elements on the blades may vary widely, depending on a number of factors. One of these factors is the formation itself, as different cutter element layouts engage and cut the various strata with differing results and effectiveness.

The cutter elements disposed on the several blades of a fixed cutter bit are typically formed of extremely hard materials and include a layer of polycrystalline diamond ("PCD") material. In the typical fixed cutter bit, each cutter element includes an elongate and generally cylindrical support member that is received and secured in a pocket formed in the surface of one of the several blades. In addition, each cutter element typically has a hard cutting layer of polycrystalline diamond or other superabrasive material such as cubic boron nitride, thermally stable diamond, polycrystalline cubic boron nitride, or ultrahard tungsten carbide (meaning a tungsten carbide material having a wear-resistance that is greater than the wear-resistance of the material forming the substrate), as well as mixtures or combinations of these materials. The cutting layer is mounted to one end of the corresponding support member, which is typically formed of tungsten carbide.

While the bit is rotated, drilling fluid is pumped through the drill string and directed out of the face of the drill bit. The fixed cutter bit typically includes nozzles or fixed ports spaced about the bit face that serve to inject drilling fluid into the passageways between the several blades. The drilling fluid exiting the face of the bit through nozzles or ports performs several functions. In particular, the fluid removes formation cuttings (for example, rock chips) from the cutting structure of the drill bit. Otherwise, accumulation of formation cuttings on the cutting structure may reduce or prevent the penetration of the drill bit into the formation. In addition, the fluid removes formation cuttings from the bottom of the hole. Failure to remove formation materials from the bottom of the hole may result in subsequent passes by cutting structure to essentially re-cut the same materials, thereby reducing the effective cutting rate and potentially increasing wear on the cutting surfaces of the cutter elements. The drilling fluid flushes the cuttings removed from the bit face and from the bottom of the hole radially outward and then up the annulus between the drill string and the borehole sidewall to the surface. Still further, the drilling fluid removes heat, caused by contact with the formation, from the cutter elements to prolong cutter element life.

BRIEF SUMMARY

Embodiments of modular fixed cutter drill bits for drilling earthen formations are disclosed herein. In one embodiment, a modular fixed cutter drill bit for drilling an earthen formation has a central axis and a cutting direction of rotation about the central axis. The drill bit comprises a bit body configured to rotate about the central axis in the cutting direction of rotation. The bit body comprises a bit face. In addition, the drill bit comprises a blade extending radially along the bit face. The blade has a leading side relative to the cutting direction of rotation, a trailing side relative to the cutting direction of rotation, and a cutter-supporting surface extending from the leading side to the trailing side. The blade comprises a socket extending from the leading side of the blade and penetrating the cutter-supporting surface of the blade. The socket has a central axis, an open end at the leading side of the blade, and a closed end distal the leading side of the blade. Further, the drill bit comprises a cutter element assembly removably mounted to the blade and extending from the cutter-supporting surface of the blade. The cutter element assembly comprises a pod seated in the socket and fixably attached to the blade. The pod has a central axis, a leading end positioned outside the socket, and a trailing end positioned in the socket. The pod comprises a pocket extending from the leading end. The cutter element assembly also comprises a cutter element disposed in the pocket. The pod is a split pod comprising a first pod section and a second pod section that are removably attached together to secure the cutter element within the pocket.

In another embodiment, a modular fixed cutter drill bit for drilling an earthen formation has a central axis and a cutting direction of rotation about the central axis. The drill bit comprises a bit body configured to rotate about the central axis in the cutting direction of rotation. The bit body includes a bit face. In addition, the drill bit comprises a blade extending radially along the bit face. The blade has a leading side relative to the cutting direction of rotation, a trailing side relative to the cutting direction of rotation, and a cutter-supporting surface extending from the leading side to the trailing side. The blade includes a socket penetrating the cutter-supporting surface of the blade. The socket has a central axis, an open end at the leading side of the blade, and a closed end distal the leading side of the blade. Further, the drill bit comprises a cutter element assembly removably mounted to the blade and extending from the cutter-supporting surface of the blade. The cutter element assembly comprises a pod seated in the socket and mechanically and removably attached to the blade. The pod has a central axis, a first end positioned outside the socket, and a second end positioned in the socket. The pod includes a pocket extending from the first end. The cutter element assembly also comprises a cutter element disposed in the pocket. The pod is a split pod comprising a first pod section and a second pod section that are removably attached together to capture the cutter element within the pocket.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which:

FIGS. 12-15 are schematic views of embodiments of cutter element assemblies in accordance with principles described herein.

DETAILED DESCRIPTION

Figure 1:
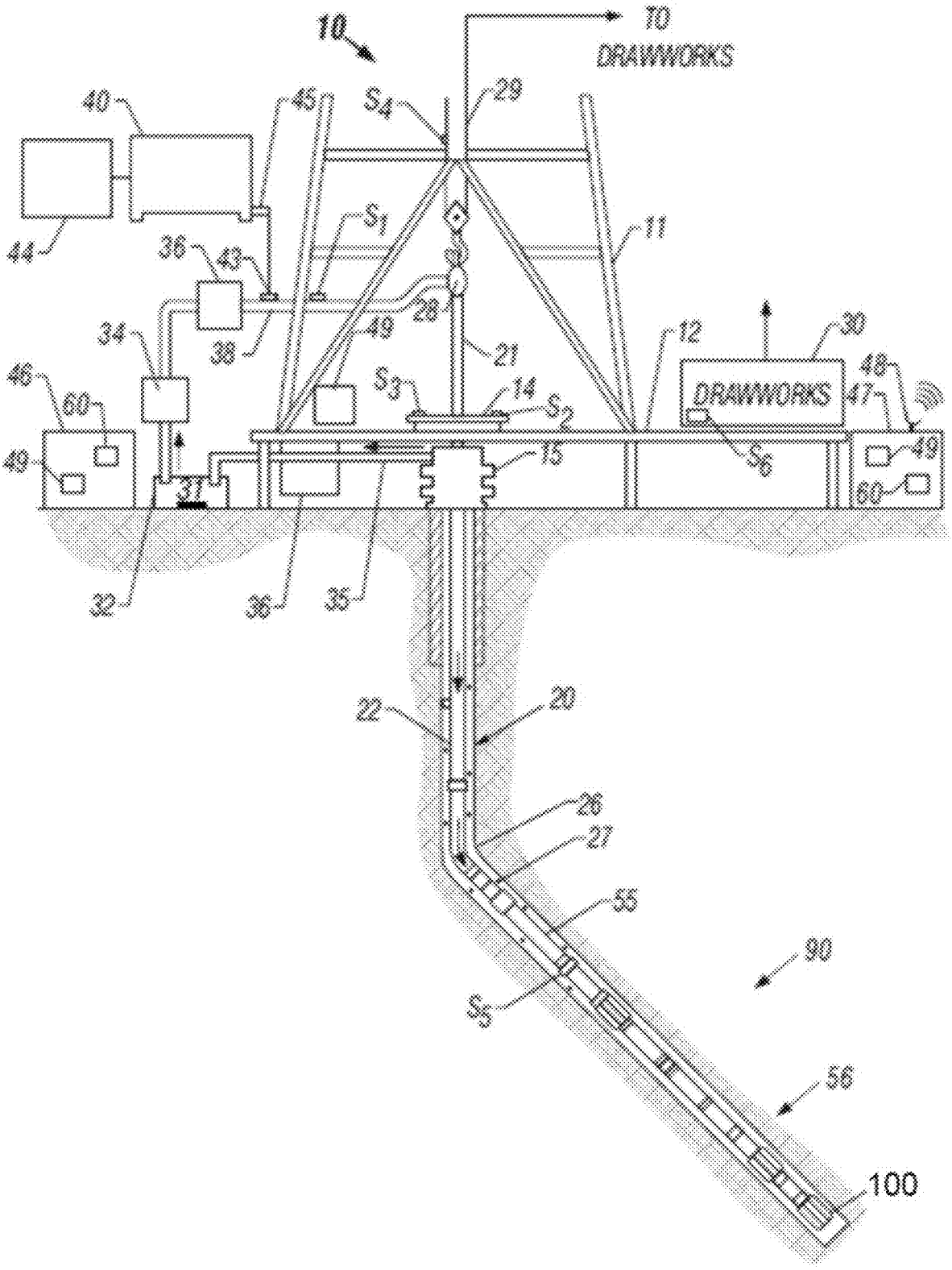
FIG. 1 is a schematic view of a drilling system including an embodiment of a drill bit in accordance with the principles described herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct engagement between the two devices, or through an indirect connection that is established via other devices, components, nodes, and connections. In addition, as used herein, the terms "axial" and "axially" generally mean along or parallel to a particular axis (e.g., central axis of a body or a port), while the terms "radial" and "radially" generally mean perpendicular to a particular axis. For instance, an axial distance refers to a distance measured along or parallel to the axis, and a radial distance means a distance measured perpendicular to the axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. As used herein, the terms "approximately," "about," "substantially," and the like mean within 10% (i.e., plus or minus 10%) of the recited value. Thus, for example, a recited angle of "about 80 degrees" refers to an angle ranging from 72 degrees to 88 degrees.

Drill bits are typically made in a manufacturing plant or factory. From the plant or factory, the drill bits are transported to the field for use. When worn, bits are typically transported to a repair center or back to the originating factory for maintenance, repair, and/or replacement. During maintenance, the bits are heated, and the cutter elements are rotated and/or replaced. After maintenance, the drill bits are then transported back to field for further use. This "lifecycle" of drill bits includes wasteful, non-value-added activities, such as transport time from and back to the field, and the associated costs. During such non-value-added activities, bits are not being used in a way that generates revenue, but instead, are idle (e.g., while being transported).

During maintenance, matrix bit bodies are susceptible to cracking when heated due to the thermal mismatch of the interior steel core (for attaching the threaded pin) and the matrix bit body. Additionally, when bits are heated, the cutter elements may sustain thermal damage, which often results in loss of wear resistance, and in extreme cases, cracking. Furthermore, when the drill bits are heated and cutter elements are brazed, there is a risk of human error that may result in the drill bit being overheated or a cutter element being positioned directly in an acetylene flame, thereby potentially causing thermal damage. It should also be appreciated that a considerable amount of time is required to heat and braze cutter elements into a drill bit, and still further time is necessary after heating the drill bit to clean the bit (e.g., remove flux). Subsequent to such heating and cleaning, the drill bits are blasted (e.g., to remove excess braze) and then dye checked for potential cracks in the bit body and/or cutter elements.

For at least the foregoing reasons, there exists a need for drill bits than can be maintained and repaired more efficiently, and for cutter elements that can be more efficiently replaced during maintenance and/or repairs. Such drill bits and associated cutter elements would be particularly well received if they offered the potential for such maintenance, repair, replacement, and rotation without enhanced risk of thermal damage to the drill bit or cutter elements.

Accordingly, embodiments described herein are directed to drill bits including cutter elements that are mechanically coupled to the blades extending from the bit bodies. In particular, the blades of the bit body are configured for relatively quick removal and attachment of cutter elements. As a result, rather than require transport to a factory or repair center, a field office can be positioned in the field for rapid drill bit build customization, repair, and maintenance. In other words, the drill bits and cutter elements thereon can be repaired, maintained, and replaced (as desired) on site, without transport over long distances (after initial delivery to the field). In addition, the cutter elements can be repaired, maintained, and replaced with relative ease. In some embodiments disclosed herein, the cutter elements can be replaced at the field location without requiring heating of the bit, which requires time for both heating and cooling of the bit, as well as presents the risk of thermal damage to the cutter elements. Further, in embodiments disclosed herein, the cutter elements can be brazed in a controlled, lab environment separate from the bit body, thereby avoiding the time required to heat and cool the entire drill bit, thereby increasing the speed of the brazing process, reducing the propensity for thermal damage to the cutter elements, and reducing the amount of time the cutter elements are exposed to a deleterious oxygen containing atmosphere at elevated temperatures.

Referring now to FIG. 1, a schematic view of an embodiment of a drilling system 10 in accordance with the principles described herein is shown. Drilling system 10 includes a derrick 11 having a floor 12 supporting a rotary table 14 and a drilling assembly 90 for drilling a borehole 26 from derrick 11. Rotary table 14 is rotated by a prime mover such as an electric motor (not shown) at a desired rotational speed and controlled by a motor controller (not shown). In other embodiments, the rotary table (for example, rotary table 14) may be augmented or replaced by a top drive suspended in the derrick (for example, derrick 11) and connected to the drillstring (for example, drillstring 20).

Drilling assembly 90 includes a drillstring 20 and a drill bit 100 coupled to the lower end of drillstring 20. Drillstring 20 is made of a plurality of pipe joints 22 connected end-to-end, and extends downward from the rotary table 14 through a pressure control device 15, such as a blowout preventer (BOP), into the borehole 26. The pressure control device 15 is commonly hydraulically powered and may contain sensors for detecting certain operating parameters and controlling the actuation of the pressure control device 15. Drill bit 100 is rotated with weight-on-bit (WOB) applied to drill the borehole 26 through the earthen formation. Drillstring 20 is coupled to a drawworks 30 via a kelly joint 21, swivel 28, and line 29 through a pulley. During drilling operations, drawworks 30 is operated to control the WOB, which impacts the rate-of-penetration of drill bit 100 through the formation. In this embodiment, drill bit 100 can be rotated from the surface by drillstring 20 via rotary table 14 or a top drive, rotated by downhole mud motor 55 disposed along drillstring 20 proximal bit 100, or combinations thereof (for example, rotated by both rotary table 14 via drillstring 20 and mud motor 55, rotated by a top drive and the mud motor 55, etc.). For example, rotation via downhole motor 55 may be employed to supplement the rotational power of rotary table 14, if required, or to effect changes in the drilling process. In either case, the rate-of-penetration (ROP) of the drill bit 100 into the borehole 26 for a given formation and a drilling assembly largely depends upon the WOB and the rotational speed of bit 100.

During drilling operations, a suitable drilling fluid 31 is pumped under pressure from a mud tank 32 through the drillstring 20 by a mud pump 34. Drilling fluid 31 passes from the mud pump 34 into the drillstring 20 via a desurger 36, fluid line 38, and the kelly joint 21. The drilling fluid 31 pumped down drillstring 20 flows through mud motor 55 and is discharged at the borehole bottom through nozzles in face of drill bit 100, circulates to the surface through an annular space 27 radially positioned between drillstring 20 and the sidewall of borehole 26, and then returns to mud tank 32 via a solids control system 36 and a return line 35. Solids control system 36 may include any suitable solids control equipment known in the art including, without limitation, shale shakers, centrifuges, and automated chemical additive systems. Control system 36 may include sensors and automated controls for monitoring and controlling, respectively, various operating parameters such as centrifuge rpm. It should be appreciated that much of the surface equipment for handling the drilling fluid is application specific and may vary on a case-by-case basis.

Figure 2:
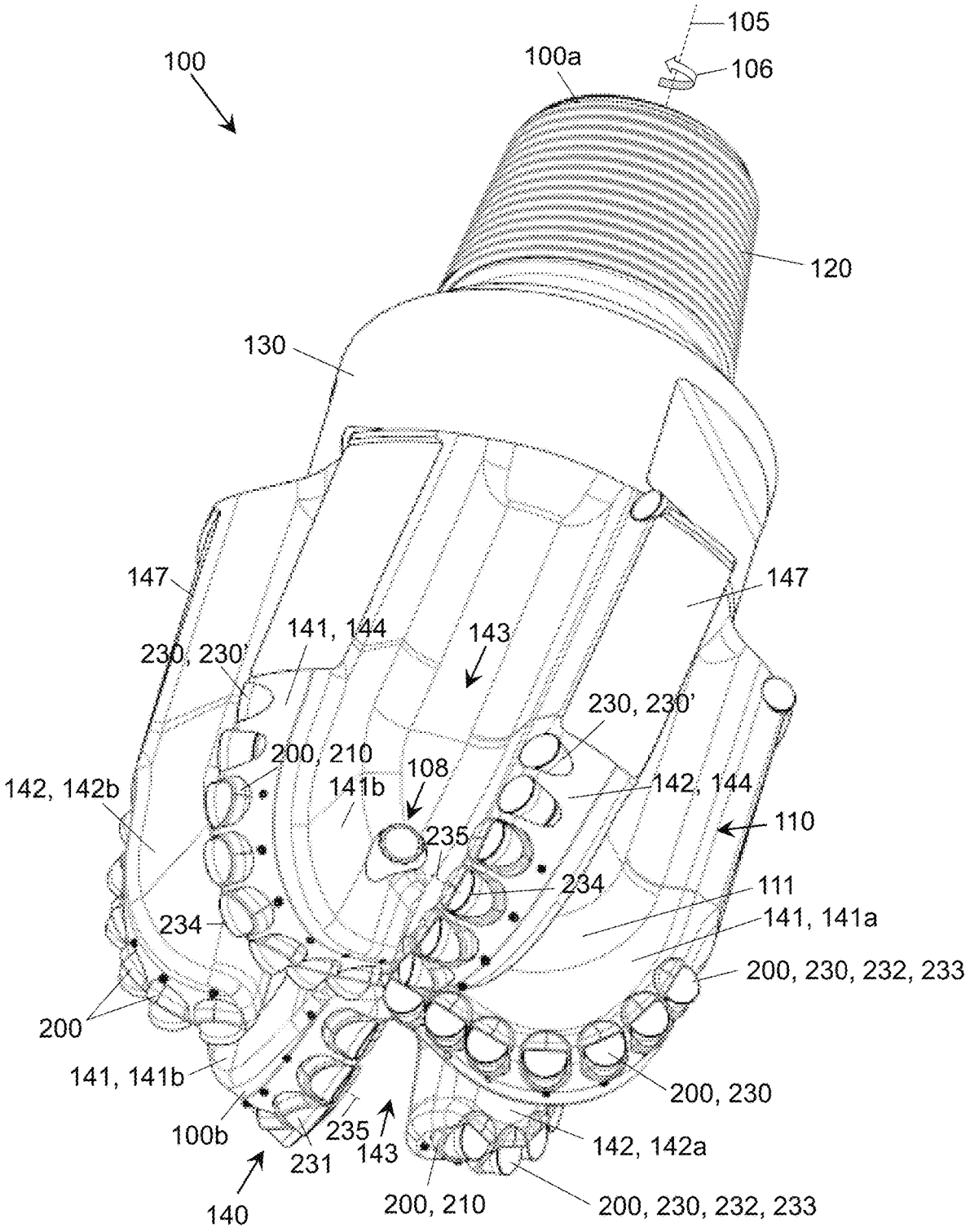
FIG. 2 is a perspective view of the drill bit of FIG. 1.
Figure 3:
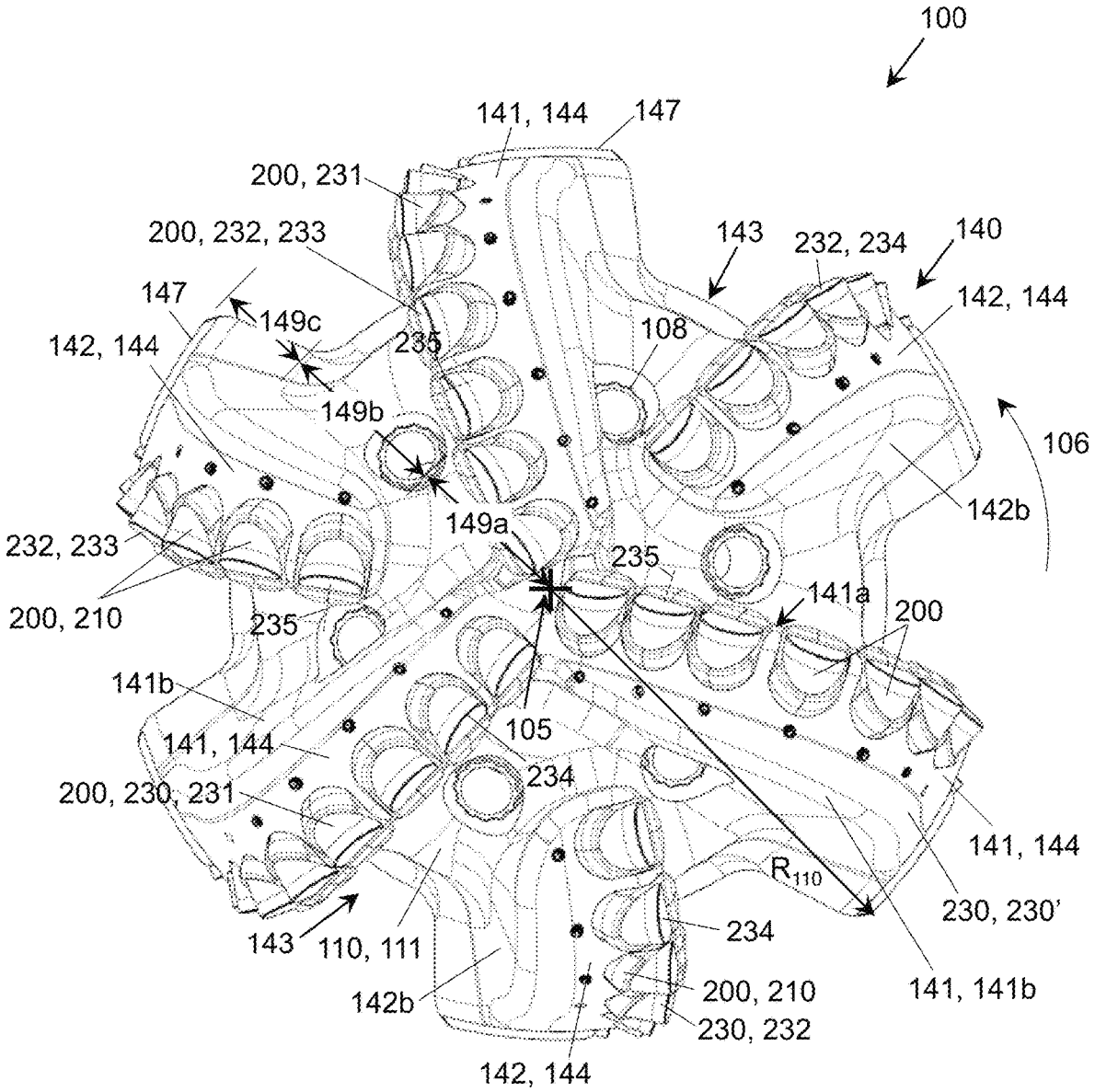
FIG. 3 is an end view of the drill bit of FIG. 2.

Referring now to FIGS. 2 and 3, drill bit 100 is a fixed cutter bit, sometimes referred to as a drag bit, and is designed for drilling through formations of rock to form a borehole. Bit 100 has a central or longitudinal axis 105, a first or uphole end 100*a*, and a second or downhole end 100*b*. Bit 100 rotates about axis 105 in the cutting direction represented by arrow 106. In addition, bit 100 includes a bit body 110 extending axially from downhole end 100*b*, a threaded connection or pin 120 extending axially from uphole end 100*a*, and a shank 130 extending axially between pin 120 and body 110. Pin 120 couples bit 100 to a drill string (not shown), which is employed to rotate the bit 100 in order to drill the borehole. Bit body 110, shank 130, and pin 120 are coaxially aligned with axis 105, and thus, each has a central axis coincident with axis 105.

Figure 4:
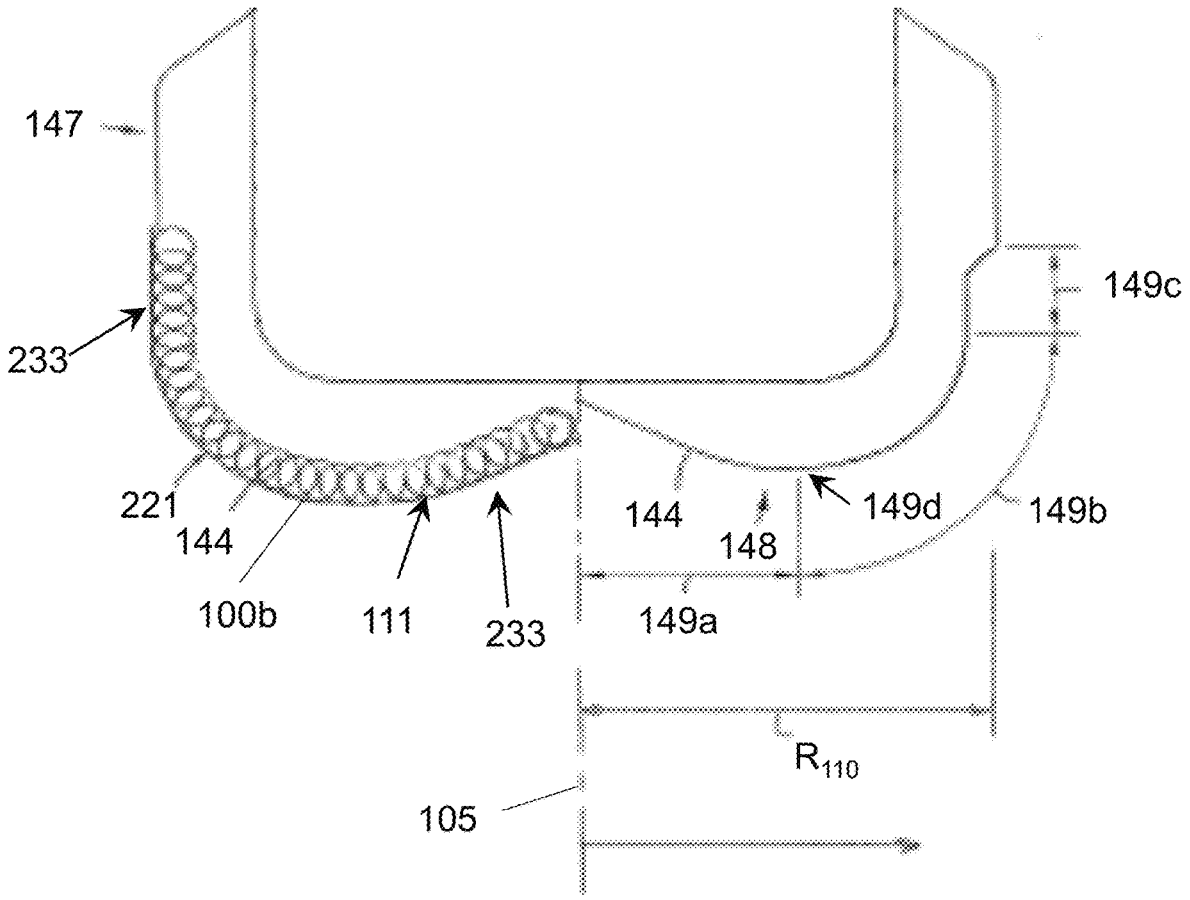
FIG. 4 is a partial cross-sectional schematic view of the bit shown in FIG. 2 with the blades and the cutting faces of the cutter elements rotated into a single composite profile.

The portion of bit body 110 that faces the formation at downhole end 100*b* includes a bit face 111 provided with a cutting structure 140. Cutting structure 140 includes a plurality of blades that extend from bit face 111. As best shown in FIG. 4, in this embodiment, cutting structure 140 includes three angularly spaced-apart primary blades 141 and three angularly spaced apart secondary blades 142. Further, in this embodiment, the plurality of blades (for example, primary blades 141, and secondary blades 142) are uniformly angularly spaced on bit face 111 about bit axis 105. In particular, the three primary blades 141 are uniformly angularly spaced about 120° apart, the three secondary blades 142 are uniformly angularly spaced about 120° apart, and each primary blade 141 is angularly spaced about 60° from each circumferentially adjacent secondary blade 142. In other embodiments, one or more of the blades may be spaced non-uniformly about bit face 111. Still further, in this embodiment, the primary blades 141 and secondary blades 142 are circumferentially arranged in an alternating fashion. In other words, one secondary blade 142 is disposed between each pair of circumferentially-adjacent primary blades 141. Although bit 100 is shown as having three primary blades 141 and three secondary blades 142, in general, bit 100 may comprise any suitable number of primary and secondary blades. As one example only, bit 100 may comprise two primary blades and four secondary blades.

Referring still to FIGS. 2 and 3, in this embodiment, primary blades 141 and secondary blades 142 are integrally formed as part of, and extend from, bit body 110 and bit face 111. Primary blades 141 and secondary blades 142 extend generally radially along bit face 111 and then axially along a portion of the periphery of bit 100. In particular, primary blades 141 extend radially from proximal central axis 105 toward the periphery of bit body 110. Primary blades 141 and secondary blades 142 are separated by drilling fluid flow courses 143. Each blade 141, 142 has a leading edge or side 141*a*, 142*a*, respectively, and a trailing edge or side 141*b*, 142*b*, respectively, relative to the direction of rotation 106 of bit 100.

Each blade 141, 142 includes a cutter-supporting surface 144 that generally faces the formation during drilling and extends circumferentially from the leading side 141*a* to the trailing side 142 of the corresponding blade 141, 142. In this embodiment, a plurality of cutter element assemblies 200 are fixably attached to each blade 141, 142 and extend from cutter-supporting surface 144 of each blade 141, 142. Cutter element assemblies 200 are generally arranged adjacent one another in a radially extending row proximal the leading side 141*a* of each primary blade 141 and each secondary blade 142. However, in other embodiments, the cutter element assemblies (for example, cutter element assemblies 200) may be arranged differently.

As will be described in more detail below, each cutter element assembly 200 includes a cutter element carrier or pod 210 fixably mounted to the corresponding blade 141, 142 and a cutter element 230 fixably secured to and carried by the pod 210. Although cutter element assemblies 200 are fixably mounted to blades 141, 142, and thus, do not move rotationally or translationally relative to blades 141, 142 during drilling operations, cutter element assemblies 200 are mechanically attached to blades 141, 142 such that any one or more cutter element assemblies 200 can be independently removed for repair, maintenance, or replacement. Accordingly, drill bit 100, as well as other embodiments of drill bits described herein, may be referred to as "modular;" and further, cutter element assemblies 200, as well as other embodiments of cutter element assemblies described herein, may be referred to as mechanically and removably attached or secured to the blades.

As will be described in more detail below, each cutter element 230 includes an elongated and generally cylindrical support base or substrate 231 and a cylindrical disk or tablet-shaped, hard cutting layer 232 bonded to the exposed end of substrate 231. Substrate 231 is typically made of a carbide material such as tungsten carbide, whereas cutting layer 232 is typically made of polycrystalline diamond or other superabrasive material. Substrate 231 has a central axis 235. As will be described in more detail below, cutter element 230 is received and secured in a pocket formed in the corresponding pod 210, which in turn is fixably received by and secured to the corresponding blade 141, 142 to which it is mounted. The cylindrical disc, hard cutting layer 232 defines a cutting face 233 of the corresponding cutter element 230. In this embodiment, each cutting face 233 is the same and is planar. However, in other embodiments, one or more cutting faces (e.g., cutting faces 233) may not be completely planar, but rather, be non-planar. As used herein, the phrase "non-planar" may be used to refer to a cutting face that includes one or more curved surfaces (for example, concave surface(s), convex surface(s), or combinations thereof), a plurality of distinct planar surfaces that intersect at distinct edges along the cutting face, or both. In this embodiment, some cutter elements 230, which are also labeled with reference numeral 230', may be directly attached to the cutter-supporting surface 144 of the corresponding blade 141, 142 without a corresponding carrier 210.

In the embodiments described herein, each cutter element assembly 200 is mounted such that the central axis 235 of the corresponding cutter element 230 is oriented substantially parallel to or at an acute angle relative to the cutting direction of the bit (for example, cutting direction 106 of bit 100). Such orientation results in the corresponding cutting face 233 being generally forward-facing relative to cutting direction 106 of bit 100. The portion of cutting face 233 of each cutter element 230 positioned furthest from the cutter-supporting surface 144 of the corresponding blade 141, 142 as measured perpendicular to the corresponding cutter-supporting surface 144 defines a cutting tip 234 of cutting face 233.

Referring still to FIGS. 2 and 3, bit body 110 further includes gage pads 147 of substantially equal axial length measured generally parallel to bit axis 105. Gage pads 147 are circumferentially-spaced about the radially outer surface of bit body 110. Specifically, one gage pad 147 intersects and extends from each blade 141, 142. In this embodiment, gage pads 147 are integrally formed as part of the bit body 110. In general, gage pads 147 can help maintain the size of the borehole by a rubbing action when cutter element assemblies 200 wear slightly under gage. Gage pads 147 also help stabilize bit 100 against vibration.

Referring now to FIG. 4, an exemplary profile of blades 141, 142 is shown as it would appear with blades 141, 142 and cutting faces 233 rotated into a single rotated profile. In rotated profile view, blades 141, 142 form a combined or composite blade profile 148 generally defined by cutter-supporting surfaces 144 of blades 141, 142. In this embodiment, the profiles of surfaces 144 of blades 141, 142 are generally coincident with each other, thereby forming a single composite blade profile 148.

Composite blade profile 148 and bit face 111 may generally be divided into three regions conventionally labeled cone region 149*a*, shoulder region 149*b*, and gage region 149*c*. Cone region 149*a* is the radially innermost region of bit body 110 and composite blade profile 148 that extends from bit axis 105 to shoulder region 149*b*. In this embodiment, cone region 149*a* is generally concave. Adjacent cone region 149*a* is generally convex shoulder region 149*b*. The transition between cone region 149*a* and shoulder region 149*b*, referred herein to as the nose 149*d*, occurs at the axially outermost portion of composite blade profile 148 (relative to bit axis 105) where a tangent line to the blade profile 148 has a slope of zero. Moving radially outward, adjacent shoulder region 149*b* is the gage region 149*c*, which extends substantially parallel to bit axis 105 at the outer radial periphery of composite blade profile 148. As shown in composite blade profile 148, gage pads 147 define the gage region 149*c* and the outer radius R110 of bit body 110. Outer radius R110 extends to and therefore defines the full gage diameter of bit 100.

Referring briefly to FIG. 3, moving radially outward from bit axis 105, bit 100 and bit face 111 include cone region 149*a*, shoulder region 149*b*, and gage region 149*c* as previously described. Primary blades 141 extend radially along bit face 111 from within cone region 149*a* proximal bit axis 105 toward gage region 149*c* and outer radius R110. Secondary blades 142 extend radially along bit face 111 from proximal nose 149*d* toward gage region 149*c* and outer radius R110. Thus, in this embodiment, each primary blade 141 and each secondary blade 142 extends substantially to gage region 149*c* and outer radius R110. In this embodiment, secondary blades 142 do not extend into cone region 149*a*, and thus, secondary blades 142 occupy no space on bit face 111 within cone region 149*a*. Although a specific embodiment of bit body 110 has been shown in described, one skilled in the art will appreciate that numerous variations in the size, orientation, and locations of the blades (for example, primary blades 141, secondary blades, 142, etc.), and cutter elements (for example, cutter element assemblies 200) are possible.

Bit 100 includes an internal plenum extending axially from uphole end 100*a* through pin 120 and shank 130 into bit body 110. The plenum allows drilling fluid to flow from the drill string into bit 100. Body 110 is also provided with a plurality of flow passages extending from the plenum to downhole end 100*b*. As best shown in FIGS. 2 and 3, a nozzle 108 is seated in the lower end of each flow passage. Together, the plenum, passages, and nozzles 108 serve to distribute drilling fluid around cutting structure 140 to flush away formation cuttings and to remove heat from cutting structure 140, and more particularly cutter element assemblies 200, during drilling.

Referring again to FIGS. 2 and 3, on each blade 141, 142, cutter element assemblies 200 are arranged side-by-side in a row along the corresponding cutter-supporting surface 144 proximal leading side 141*a*, 142*a*. Thus, in this embodiment, cutter element assemblies 200 are positioned radially adjacent one another (relative to bit axis 105) on a given blade 141, 142. However, in other embodiments, the cutter element assemblies (for example, cutter element assemblies 200) may be arranged in rows with one or more cutter element having different geometries on the same blade (for example, blade 141, 142).

Figure 5:
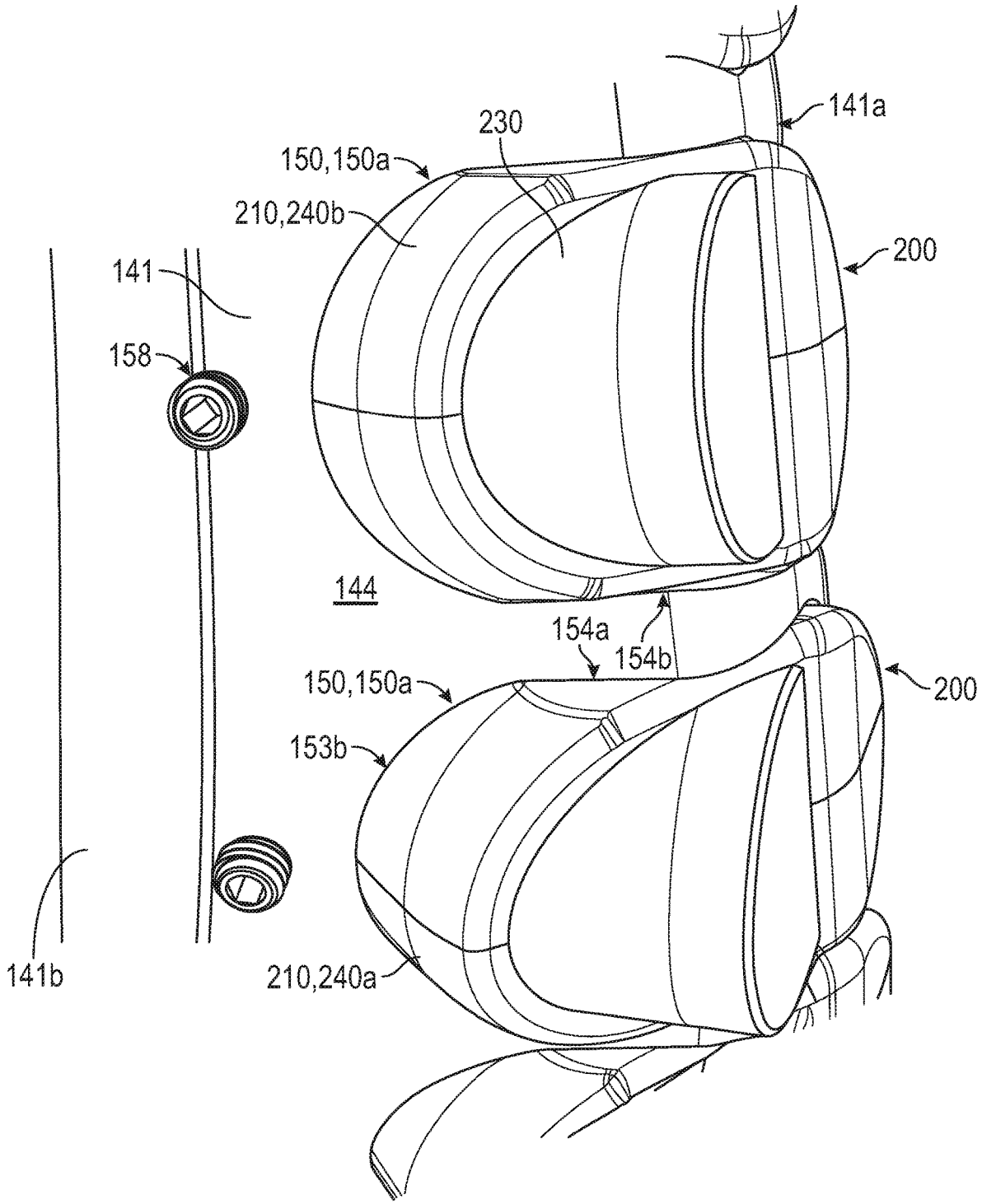
FIG. 5 is an enlarged, partial end view of one of the blades of the drill bit of FIG. 2.
Figure 6:
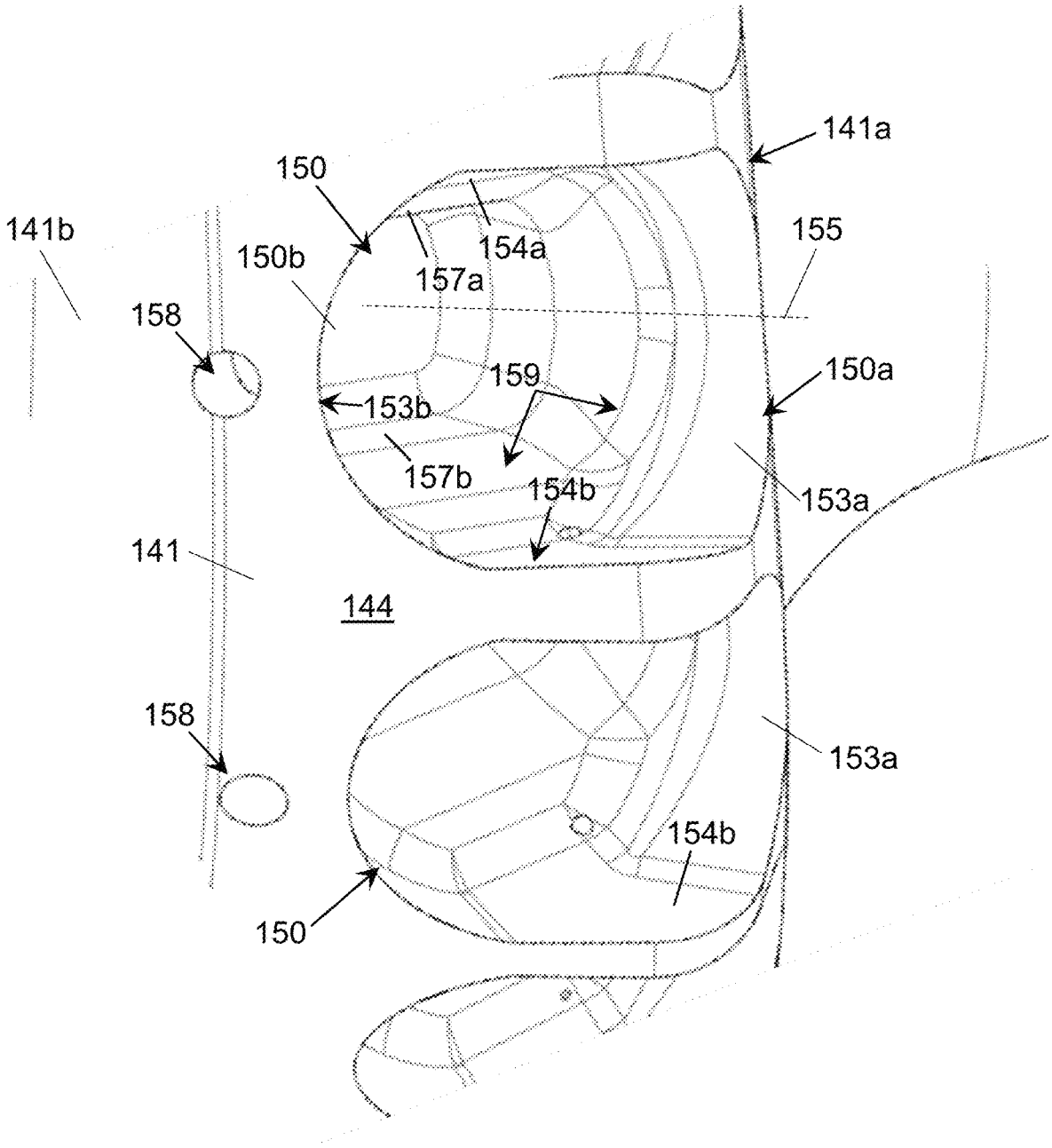
FIG. 6 is an enlarged, partial end view of the blade of FIG. 5 with the cutter element assemblies removed.

Referring now to FIGS. 5 and 6, enlarged views of one exemplary blade 141 are shown. In FIG. 5, cutter element assemblies 200 are shown mounted to blade 141, however, in FIG. 6, cutter element assemblies 200 are removed. Although one exemplary primary blade 141 is shown in FIGS. 5 and 6 and will be described, it is to be understood that the other primary blades 141 and secondary blades 142 are generally the same.

Blade 141 includes a plurality of radially adjacent sockets 150 for receiving cutter element assemblies 200, and in particular, for receiving mating cutter element pods 210 of cutter element assemblies 200. Each socket 150 extends into the blade 141 generally perpendicularly from leading side 141*a* and cutter-supporting surface 144. Thus, each socket 150 intersects and extends through leading side 141*a*, cutter-supporting surface 144, and the convex edge between the corresponding cutter-supporting surface 144 and leading side 141*a*.

Figure 7:
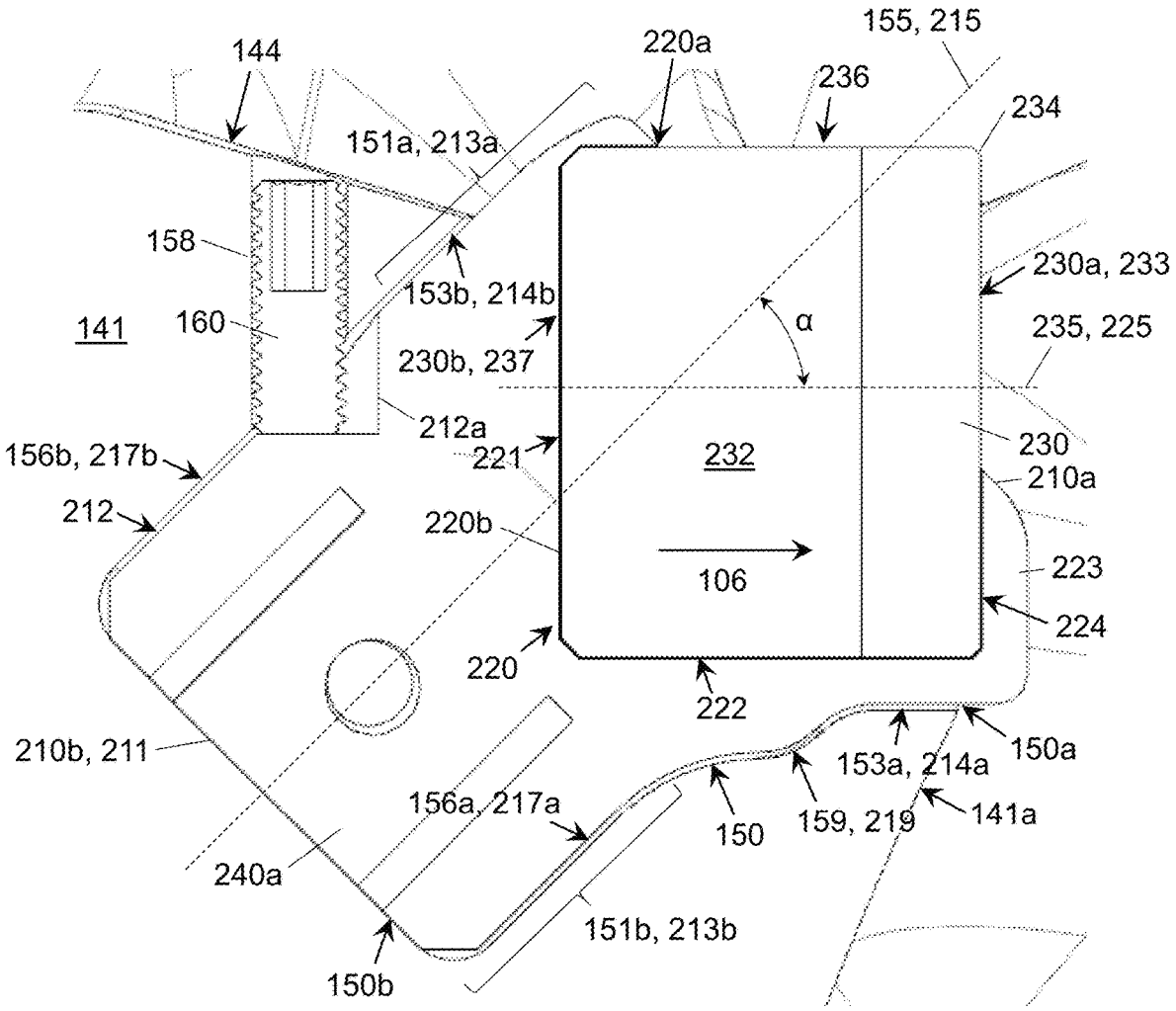
FIG. 7 is an enlarged cross-sectional side view of the blade and a partial side view of one cutter element assembly of FIG. 5.

Referring now to FIGS. 6 and 7, one socket 150 will be described it being understood the other sockets 150 are the same. Socket 150 has a central or longitudinal axis 155, a first or open end 150*a* penetrating cutter-supporting surface 144 and leading side 141*a*, and a second or closed end 150*b* axially opposite open end 150*a* and distal cutter-supporting surface 144 and leading side 141*a*. In this embodiment, closed end 150*b* is defined by a planar surface oriented perpendicular to central axis 155. In addition, in this embodiment, central axis 155 is oriented at an acute angle $\alpha$ relative to central axis 235 of substrate 232 of the corresponding cutter element 230 and relative to cutting direction 106 of bit 100 at the radial position of the corresponding cutter element 230. Open end 150*a* is positioned forward of and leads closed end 150*b* relative to relative to cutting direction 106 of bit 100. Accordingly, open end 150*a* may also be referred to as leading end 150*a* of socket 150 and closed end 150*b* may also be referred to as trailing end 150*b* of socket 150.

Referring still to FIGS. 6 and 7, in this embodiment, socket 150 may be described as including a first section 151*a* extending axially from open end 150*a* and a second section 151*b* extending axially from closed end 150*b* to first section 151*a*. First section 151*a* has a generally rectangular cross-sectional geometry with semi-circular ends in a plane oriented perpendicular to axis 155. In particular, first section 151*a* is defined by a leading semi-cylindrical surface 153*a* extending from leading side 141*a* at open end 150*a* to second section 151*b*, a trailing semi-cylindrical surface 153*b* extending from cutter-supporting surface 144 to second section 151*b*, and a pair of parallel, planar lateral side surfaces 154*a*, 154*b* extending from open end 150*a* to second section 151*b*. Lateral side surfaces 154*a*, 154*b* extending between surfaces 153*a*, 153*b*. Surfaces 153*b* 154*a*, 154*b* are oriented parallel to axis 155, whereas surface 153*a* is oriented at acute angle $\alpha$ relative to central axis 155. Accordingly, leading surface 153*a* generally slopes toward central axis 155 moving axially from end 150*a* to second section 151*b*. Lateral side surfaces 154*a*, 154*b* are oriented parallel to axis 155 and cutting direction 106.

Second section 151*b* has a generally rectangular cross-sectional geometry in a plane oriented perpendicular to axis 155. In particular, second section 151*b* is defined by a leading planar surface 156*a* extending from leading surface 153*a* of first section 151*a* to closed end 150*b*, a trailing planar surface 156*b* extending from trailing surface 153*b* of first section 151*a* to closed end 150*b*, and a pair of parallel, planar lateral side surfaces 157*a*, 157*b* extending from side surfaces 154*a*, 154*b*, respectively, of first section 151*a* to closed end 150*b*. Lateral side surfaces 157*a*, 157*b* extend between surfaces 156*a*, 156*b* and are oriented parallel to side surfaces 154*a*, 154*b* of first section 151*a*. Thus, lateral side surfaces 157*a*, 157*b* are oriented parallel to cutting direction 106. Leading and trailing surfaces 156*a*, 156*b* are oriented parallel to each other and perpendicular to lateral side surfaces 157*a*, 157*b*. In this embodiment, surfaces 156*a*, 156*b*, 157*a*, 157*b* are oriented parallel to axis 155, and further, the intersections between surfaces 156*a*, 156*b*, 157*a*, 157*b* are radiused or curved. A bore 158 extends from cutter-supporting surface 144 through blade 141 to trailing planar surface 156*b*. As will be described in more detail below, a screw 160, such as a threaded pin, set screw, or hex screw, is advanced through bore 158 to secure pod 210 of cutter element assembly 200 within socket 150. Bore 158 may be internally threaded (e.g., in a steel bit body) such that screw 160 can be threaded therethrough; or an additional component such as a Helicert, Helicoil, or anchor sleeve as are known in the art may be advanced into bore 158 (e.g., in a matrix bit body), and then screw 160 can be threaded therethrough.

As best shown in FIG. 7, trailing surfaces 153*b*, 156*b* of sections 151*a*, 151*b* are contiguous and oriented in a common plane. However, lateral side surfaces 154*a*, 154*b* of first section 151*a* are positioned radially outside corresponding lateral side surfaces 157*a*, 157*b* of second section 151*b*, and leading surface 153*a* is positioned radially further from central axis 155 than corresponding leading surface 156*a*. Accordingly, in this embodiment, socket 150 includes a generally U-shaped concave recess 159 that extends radially inward moving axially from first section 151*a* to second section 151*b* between leading surfaces 153*a*, 156*a*, side surfaces 154*a*, 157*a*, and side surfaces 154*b*, 157*b*.

Figure 8:
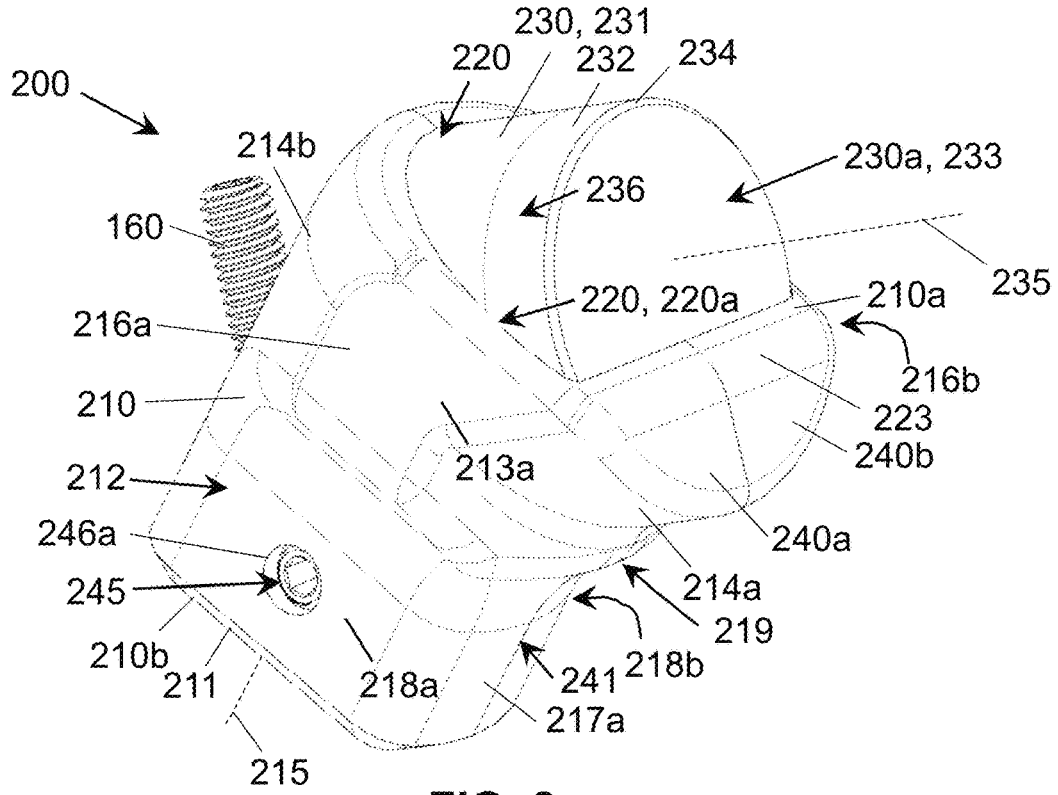
FIG. 8 is a perspective view of one of the cutter element assemblies of the bit of FIG. 2.
Figure 9:
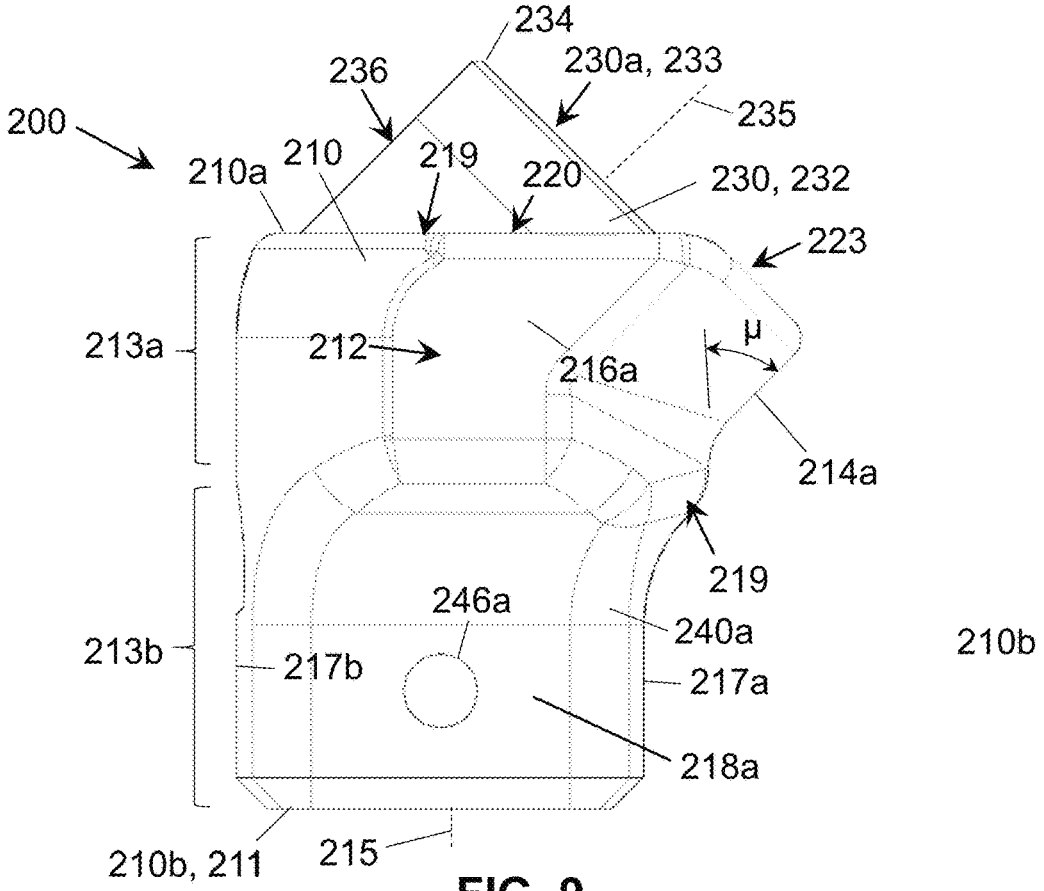
FIG. 9 is a side view of the cutter element assembly of FIG. 8.

Referring now to FIGS. 7 to 9, one cutter element assembly 200 will be described it being understood that each cutter element assembly 200 is the same. As previously described, cutter element assembly 200 includes cutter element pod 210 and cutter element 230 fixably mounted and secured thereto. As also previously described, cutter element 230 includes cylindrical substrate 231 and cylindrical hard cutting layer 232 bonded to substrate 231. Substrate 231 has a central axis 235, and cutting layer 232 defines a cutting face 233. More specifically, cutter element 230 has a leading end 230*a* relative to cutting direction 106 of bit 100, a trailing end 230*b* axially opposite end 230*a* (relative to axis 235), and a radially outer cylindrical surface 236 extending axially from leading end 230*a* to trailing end 230*b*. Cutting face 233 is disposed at leading end 230*a*. Trailing end 230*b* comprises a planar surface 237. In this embodiment, cutting face 233 and planar surface 236 are disposed in planes oriented perpendicular to axis 235. Cylindrical outer surface 236 extends axially from leading end 230*a* to trailing end 230*b* along both cutting layer 232 and substrate 231. Cutting tip 234 is positioned at the intersection of cutting face 233 and cylindrical outer surface 236.

Cutter element pod 210 has a central axis 215, a first or open end 210*a*, and a second end 210*b* opposite end 210*a*. When cutter element assembly 210 is seated in a mating socket 150, first end 210*a* is positioned forward of and leads second end 210*b* relative to the cutting direction 106 of bit 100. Accordingly, first end 210*a* may also be referred to as leading end 210*a*, and second end 210*b* may also be referred to as trailing end 210*b*. In this embodiment, trailing end 210*b* is defined by a planar surface 211 oriented perpendicular to axis 215 and a cylindrical recess or pocket 220 extends from leading end 210*a*. As best shown in FIG. 7, pocket 220 has a central axis 225 oriented at acute angle α relative to central axis 215. In this embodiment, pocket 220 is partially closed at leading end 210*a*. As will be described in more detail below, a mating cutter element 230 is received and captured in pocket 220 with central axes 225, 235 coaxially aligned.

Referring still to FIGS. 7 to 9, cutter element pod 210 has a radially outer surface 212 extending axially from leading end 210*a* to trailing end 210*b*. Outer surface 212 is sized and shaped to mate with socket 150. In particular, cutter element pod 210 may be described as including a first section 213*a* extending axially from open end 210*a* and a second section 213*b* extending axially from second end 210*b* to first section 213*a*. First section 213*a* is sized and shaped to mate with first section 151*a* of socket 150, and second section 213*b* is sized and shaped to mate with second section 151*b* of socket 150. Thus, first section 213*a* has a generally rectangular cross-sectional geometry with semi-circular ends in a plane oriented perpendicular to axis 215. In particular, along first section 213*a*, outer surface 212 of pod 210 includes a leading semi-cylindrical surface 214*a* extending from first end 210*a* to second section 213*b*, a trailing semi-cylindrical surface 214*b* extending from first end 210*a* to second section 213*b*, and a pair of parallel, planar lateral side surfaces 216*a*, 216*b* extending from first end 210*a* to second section 213*b*. Lateral side surfaces 216*a*, 216*b* extending between surfaces 214*a*, 214*b*. As best shown in FIG. 9, surfaces 214*b*, 216*a*, 216*b* are oriented parallel to axis 215, whereas surface 214*a* is oriented at acute angle α relative to central axis 215. Accordingly, leading surface 214*a* generally slopes toward central axis 215 moving axially from end 210*a* to second section 213*b*. Acute angle α is the same as acute angle α previously described. As best shown in FIGS. 5 and 7, when cutter element assembly 200 is seated in socket 150, axes 155, 215 are coaxially aligned, surfaces 214*a*, 214*b* slidingly engage mating surfaces 153*a*, 153*b*, respectively, surfaces 216*a*, 216*b* slidingly engage mating surfaces 154*a*, 154*b*, respectively, and lateral side surfaces 216*a*, 216*b* are oriented parallel to cutting direction 106.

Referring still to FIGS. 8 and 9, as previously described, second section 213*b* is sized and shaped to mate with second section 151*b* of socket 150. Thus, second section 213*b* has a generally rectangular cross-sectional geometry in a plane oriented perpendicular to axis 215. In particular, along second section 213*b*, outer surface 212 of pod 210 includes a leading planar surface 217*a* extending from leading surface 214*a* of first section 213*a* to second end 210*b*, a trailing planar surface 217*b* extending from trailing surface 214*b* of first section 213*a* to second end 210*b*, and a pair of parallel, planar lateral side surfaces 218*a*, 218*b* extending from side surfaces 216*a*, 216*b*, respectively, of first section 213*a* to second end 210*b*. Lateral side surfaces 218*a*, 218*b* extend between surfaces 217*a*, 217*b* and are oriented parallel to side surfaces 216*a*, 216*b* of first section 213*a*. Leading and trailing surfaces 217*a*, 217*b* are oriented parallel to each other and perpendicular to lateral side surfaces 218*a*, 218*b*. In this embodiment, surfaces 217*a*, 217*b*, 218*a*, 218*b* are oriented parallel to axis 215, and further, the intersections between surfaces 217*a*, 217*b*, 218*a*, 218*b* are radiused or curved. As best shown in FIGS. 5 and 7, when cutter element assembly 200 is seated in socket 150, axes 155, 215 are coaxially aligned, surfaces 217*a*, 217*b* slidingly engage mating surfaces 156*a*, 156*b*, respectively, surfaces 218*a*, 218*b* slidingly engage mating surfaces 157*a*, 157*b*, respectively, and lateral side surfaces 218*a*, 218*b* are oriented parallel to cutting direction 106.

As best shown in FIG. 7, trailing surfaces 214*b*, 217*b* of sections 213*a*, 213*b* are contiguous and oriented in a common plane. However, lateral side surfaces 216*a*, 216*b* of first section 213*a* are positioned radially outside corresponding lateral side surfaces 218*a*, 218*b* of second section 213*b*, and leading surface 214*a* is positioned radially further from central axis 215 than corresponding leading surface 217*a*. Accordingly, in this embodiment, pod 210 includes a generally U-shaped convex shoulder 219 that extends radially inward moving axially from first section 213*a* to second section 213*b* between leading surfaces 214*a*, 217*a*, side surfaces 216*a*, 218*a*, and side surfaces 216*b*, 218*b*. As best shown in FIG. 7, when cutter element assembly 200 is seated in socket 150, convex shoulder 219 is seated against mating concave recess 159.

As best shown in FIG. 7, outer surface 212 includes a recess or counterbore 212*a* along trailing planar surface 217*b*. Counterbore 212*a* is oriented at an acute angle relative to planar surface 217*b* and axis 215. When cutter element assembly 200 is seated in socket 150, counterbore 212*a* is generally coaxially aligned with bore 157 in blade 141 such that screw 160 can be threadably advanced through bore 158 and into counterbore 212*a* to secure cutter element assembly 200 in socket 150 (i.e., to restrict and/or prevent cutter element assembly 200 from being pulled or removed from socket 150).

Referring again to FIGS. 7-9, pod 210 includes cylindrical pocket 220 extending from end 210*a*. Pocket 220 extends from end 210*a* into first section 213*a* of pod 210, and is sized and shaped to receive mating cutter element 230. More specifically, pocket 220 has a first or open end 220*a* at leading end 210*a* of pod 210, and a second or closed end 220*b* distal leading end 210*a* of pod 210. Pocket 220 is defined by an inner planar surface 221 at end 220*b* (within first section 213*a*) and a cylindrical surface 222 extending from end 220*a* to end 220*b* (within first section 213*a*). In this embodiment, open end 220*a* of pocket 220 is partially closed by a lip or flange 223 of first section 213*a* that extends radially inward (relative to axis 235) from leading surface 214*a*. Flange 223 includes a planar surface 224 that is oriented parallel to and faces planar surface 221. As best shown in FIG. 7, when cutter element 230 is disposed in pocket 220, planar surface 237 of cutter element 230 is flush with and slidingly engages planar surface 221 of first section 213*a*, cylindrical surface 236 of cutter element 230 slidingly engages cylindrical surface 221 of first section 213*a*, and planar surface 224 of flange 223 is flush with and sildingly engages cutting face 233 of cutter element 230 radially opposite cutting tip 234.

Cutter element pod 210 can be made of any suitable material for a particular application and/or to enhance durability of cutter element assembly 200. For example, pod 210 (or portion thereof) can be made of a high strength material, a high abrasion resistant material, a corrosion resistant material, or combinations thereof. Examples of suitable materials for pod 210 include, without limitation, steel, super alloy, cemented carbide, matrix or similar high-performance or hard material, Stellite, Inconel, Monel, metal alloys with niobium or nickel, or combinations thereof (e.g., steel, carbide, steel, hardfacing, superalloy, and carbide).

Figure 10:
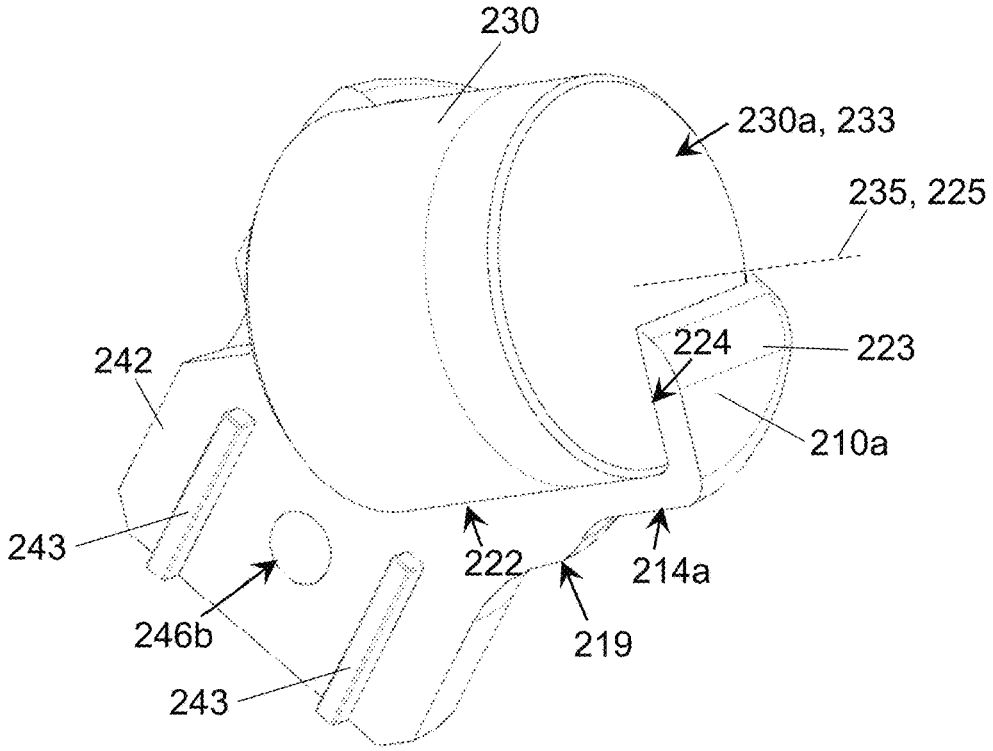
FIG. 10 is a perspective view of the cutter element assembly of FIG. 8 with half of the split pod removed.
Figure 11:
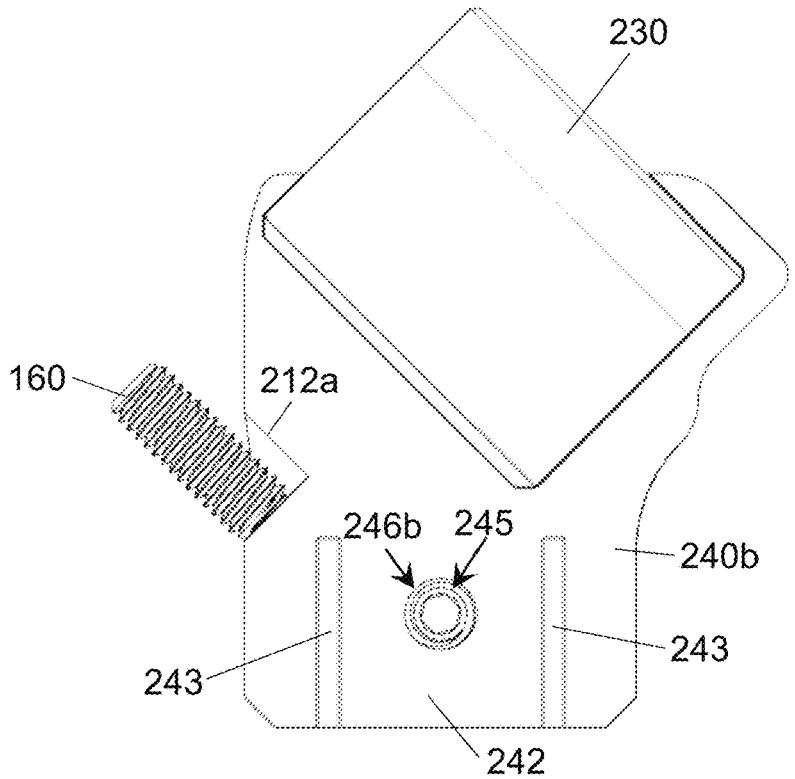
FIG. 11 is a side view of the cutter element assembly of FIG. 10.

Referring now to FIGS. 8, 10, and 11, in this embodiment, cutter element 230 is captured within pocket 220 via interference fit. More specifically, in this embodiment, cutter element pod 210 is a "split" pod formed by a pair of pod sections 240*a*, 240*b* that are removably attached together with cutter element 230 disposed therebetween to simultaneously form pod 210, form pocket 220, and capture cutter element 230 in pocket 220 to form cutter element assembly 200. Pod sections 240*a*, 240*b* are substantially the same, and each pod section 240*a*, 240*b* defines half of pod 240. The joint or interface 241 (FIG. 8) between pods 240*a*, 240*b* is disposed along a plane that contains axes 215, 225, 235 and divides pod 210 into mirror image halves (i.e., pod sections 240*a*, 240*b* are mirror image halves of pod 210). Accordingly, each pod section 240*a*, 240*b* defines half of pod 210, and hence, half of first section 213*a*, half of second section 213*b*, and half of pocket 220. Each pod section 240*a*, 240*b* has a planar interface surface 242 that faces and seats flush against the interface surface 242 of the other pod section 240*a*, 240*b* along interface 241.

In this embodiment, pod sections 240*a*, 240*b* include interlocking structures to ensure pod sections 240*a*, 240*b* are properly aligned and oriented to facilitate formation of pod 210 and pocket 220. The interlocking structures generally include one or more projections 243 extending perpendicularly from planar interface surface 242 of one pod section 240*a*, 240*b* and one or more corresponding, mating recesses (not shown) extending perpendicularly from the planar interface surface 242 of the other pod section 240*a*, 240*b*. In this embodiment, pod section 240*b* includes a pair projections 243 extending perpendicularly from interface surface 242 of pod section 240*b* and the opposed pod section 240*a* includes a pair of mating recesses (not shown) extending from interface surface 242 of pod section 240*a*. In particular, projections 243 of pod section 240*b* are elongate ribs and mating recesses of pod section 240*a* are elongate recesses sized and shaped to mate and slidingly receive the elongate ribs of pod section 240*b*. Thus, projections 243 of pod section 240*b* mate with and are seated in the corresponding recesses of pod section 240*a* when interface surfaces 242 of pod sections 240*a*, 240*b* are pushed together to ensure pod sections 240*a*, 240*b* are properly aligned and oriented to form pod 210 as shown in FIG. 8. In other embodiments, additional and/or different types of interlocking structures to ensure proper alignment and orientation of the pod sections (e.g., pod sections 240*a*, 240*b*) such as, for example, mating pins and counterbores may be provided.

Referring now to FIGS. 8 and 9, pod sections 240*a*, 240*b* are fixably coupled together to form pod 210 and cutter element assembly 200 by coupling pod sections 240*a*, 240*b* together with ribs 243 seated in mating recesses and an externally threaded member 245 fixably securing pod sections 240*a*, 240*b* together. In this embodiment, threaded member 245 extends through a bore 246*a* in pod section 240*a* with a head of threaded member 245 seated against an annular shoulder along bore 246*a*. In general, threaded member 245 can be a bolt (e.g., a hex head bolt with a nut on the opposite side of pod 210) or a screw (e.g., a hex head screw or set screw threaded into mating internal threads along bore 246*b*) with interface surfaces 242 engaging flush to each other and ribs 243 of pod section 240*a* seated in mating recesses of pod section 240*b*. In this embodiment, coaxially aligned bores 246*a*, 246*b* extend through second section 213*b* of pod 210.

In general, each cutter element assembly 200 is assembled in the foregoing manner. In some embodiments, cutter element 230 may be brazed to pod 210 once captured within pocket 220 (i.e., after cutter element 200 is formed). For example, melted or "wet" brazing filler material can be applied between slidingly engaging and mating cylindrical surfaces 221, 236 of pod 210 and cutter element 230, respectively, and flows therebetween via capillary action. It should be appreciated that by capturing cutter element 230 within pocket 220 via interference fit alone (i.e., without brazing), cutter element 230 is not exposed to excessive heat that would otherwise be generated by the brazing process.

Referring again to FIGS. 5-7, once formed as described above, cutter element assembly 200 is fixably and mechanically secured to the corresponding blade 141, 142 within a corresponding socket 150. In particular, cutter element assembly 200 is aligned with a socket 150 of the blade 141, 142 such that central axis 215 of cutter element assembly 200 is generally coaxially aligned with central axis 155 of socket 150 with cutting face 233 in a forward-facing orientation. Next, second end 210*b* of pod 210 is first inserted into socket 150 and cutter element assembly 200 is axially advanced (relative to axes 155, 215) into socket 150 to position second section 213*b* of pod 210 into mating second section 151*b* of socket 150, and position first section 213*a* of pod 210 into mating first section 151*a* of socket 150. Cutter element assembly 200 is fully seated in socket 150 with surface 211 flush against the planar surface defining end 150*b* of socket 150, surfaces 214*a*, 214*b* slidingly engaging mating surfaces 153*a*, 153*b*, respectively, surfaces

216*a*, 216*b* slidingly engaging mating surfaces 154*a*, 154*b*, surfaces 217*a*, 217*b* slidingly engaging mating surfaces 156*a*, 156*b*, respectively, surfaces 218*a*, 218*b* slidingly engaging mating surfaces 157*a*, 157*b*, and convex shoulder 219 seated against mating concave recess 159. With cutter element assembly 200 fully seated in socket 150, through bore 158 and counterbore 212*a* are in coaxial alignment, and screw 160 is threadably advanced through bore 158 and into counterbore 212*a* to secure cutter element assembly 200 in socket 150 (i.e., to restrict and/or prevent cutter element assembly 200 from being pulled or removed from socket 150) as previously described. In some embodiments, the connection between cutter element assembly 200 and corresponding blade 141, 142 may be further strengthened via an interference fit between pod 210 and blade 141, 142 within socket 150, Loctite™ or epoxy between pod 210 and blade 141, 142 within socket 150, a tack weld or spot weld between pod 210 and blade 141, 142, or combinations thereof.

With cutter element assembly 200 seated in socket 150, second section 213*b* of pod 210 is surrounded by the corresponding blade 141, thereby shielding and protecting threaded member 245 from debris and harsh conditions during drilling operations. In general, this approach can be employed to mount cutter element assemblies 200 to blades 141, 142 to form bit 100. It should be appreciated that the foregoing process can be performed in reverse to remove one or more cutter element assemblies 200 from blades 141, 142.

In the manner described, cutter element assembly 200 is fixably and mechanically secured to a corresponding blade 141, 142. It should be appreciated that set screw 217 (disposed in bore 158 and into counterbore 212*a*) prevents cutter element assembly 200 from sliding axially (relative to axes 155, 235) out of mating socket 150, while mating engagement of pod 210 and socket 150 prevents pod 210 (and hence, cutter element assembly 200) from rotating relative to the corresponding blade 141, 142. Thus, cutter element assembly 200 is fixably attached to the corresponding blade 141, 142 such that it cannot move rotationally or translationally relative thereto. However, cutter element assembly 200 can be removed from the corresponding blade 141, 142 for repair or replacement. Thus, cutter element assembly 200 may be described as being mechanically attached to the corresponding blade 141, 142 and removably attached to the corresponding blade 141, 142.

To replace or repair a worn or damaged cutter element 230 of drill bit 100, the corresponding cutter element assembly 200 is removed as previously described. Next, cutter element 230 is removed from pocket 220 of pod 210 by simply unbolting pod sections 240*a*, 240*b* (unthread threaded member 245), and then pulling pod sections 240*a*, 240*b* apart to allow cutter element 230 to be removed from the halves of pocket 220. If Loctite™, epoxy, tack weld, or spot weld was used between pod 210 and blade 141, 142 along socket 150, such additional materials may be ground away from pod 210 and blade 141, 142. In embodiments where cutter element 230 is brazed to pod 210, cutter element 230 can be removed from pocket 220 by heating pod 210 and/or cutter element 230 to melt the brazing therebetween, unbolting pod sections 240*a*, 240*b*, pulling pod sections 240*a*, 240*b* apart, and then removing cutter element 230 from the halves of pocket 220 while the brazing remains melted. Once cutter element 230 is removed, it can be replaced with a new or repaired cutter element 230, reinstalled in pocket 220 as previously described to reform cutter element assembly 200, and then cutter element assembly 200 with the new or repaired cutter element 230 is reinstalled on bit 100 as previously described. In some cases, it may be desirable to simply rotate cutter element 230 within pocket 220 (rather than remove and replace a worn cutter element 230 with a new or repaired cutter element 230) to position a fresh or unworn portion of the cutting edge of cutting layer 232 for engaging the formation during subsequent drilling operations (i.e., position a fresh or unworn portion of the cutting edge at tip 234). In such cases, cutter element assembly 200 is removed from bit 100 as previously described, pod sections 240*a*, 240*b* are pulled apart, cutter element 230 is rotated about axis 235 as desired, and then cutter element assembly 200 is reformed as previously described and installed back on bit 100 as previously described. Although the foregoing described a new or repaired cutter element 230 being installed in a previously used pod 210, if such used pod 210 is sufficiently worn or damaged, it can also be replaced with a new or repaired pod 210.

In embodiments where cutter element 230 is brazed to pod 210 within pocket 220, the foregoing processes for installing and capturing cutter element 230 in pod 210, removing cutter element 230 from pod 210, and rotating cutter element 230 relative to pod 210 are performed after cutter element assembly 200 is removed from bit 100 (i.e., performed without pod 210 attached to bit body 110), which offers the potential to speed the process by eliminating the need to heat and cool the entire bit body 110, as well as enable the brazing to be done in a controlled lab environment separate from the bit body 110. To minimize exposure of cutter element 230 to excess heat, pod 210 can be heated and/or a heat sink applied to cutter element 230.

In the manner described, worn and/or damaged cutter elements 230 of cutter element assemblies 200 can be replaced or rotated to define a new and/or fresh cutting edge for engaging and shearing the formation. This process can be performed relatively quickly, accurately, and with reduced risk of thermal damage to the underlying bit body 110 as previously described. It should be appreciated that cutter elements (e.g., cutter elements 230) positioned in certain regions of a fixed cutter drill bit (e.g., bit 100) are more susceptible to wear and damage than cutter elements located in different regions of the drill bit. For example, cutter elements positioned along blades (e.g., blades 141, 142) proximal at or proximal the nose (149*d*) and along the shoulder region (e.g., region 149*b*) often experience greater impact loads and wear than cutter elements located in the cone region (e.g., cone region 149*a*) and gage region (e.g., gage region 149*c*). Accordingly, embodiments of cutter element assemblies described herein (e.g., cutter element assemblies 200) that enable the relatively quick, accurate, and safe replacement or rotation of cutter elements may be particularly beneficial along those regions of the drill bit where the cutter elements are likely to experience the greatest risk of wear and/or damage such as at or proximal the nose and the shoulder region. For example, as shown in FIGS. 2 and 3, cutter element assemblies 200 are positioned on blades 141, 142 at the nose 149*d* and in shoulder region 149*b*, whereas cutter elements 230' that are directly mounted to corresponding blades 141, 142 (i.e., cutter elements 230 that are not part of a cutter element assembly 200) are positioned in gage region 149*c*. Although cutter element assemblies 200 are also positioned along blades 141 in cone region 149*a* of drill bit 100 in such embodiment, in other embodiments, cutter elements 230' directly mounted to corresponding blades 141 in cone region 149*a* may replace cutter element assemblies 200 in cone region 149*a*.

Figure 12:
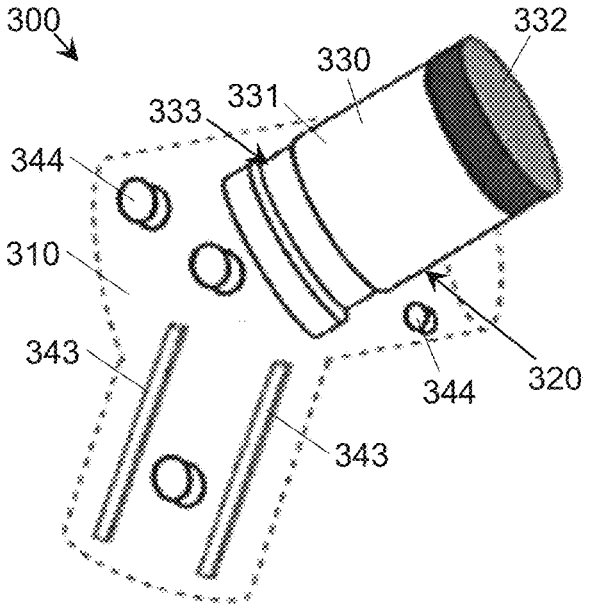
FIG. 12 is a perspective view of the half of the split pod of FIG. 10.
Figure 13:
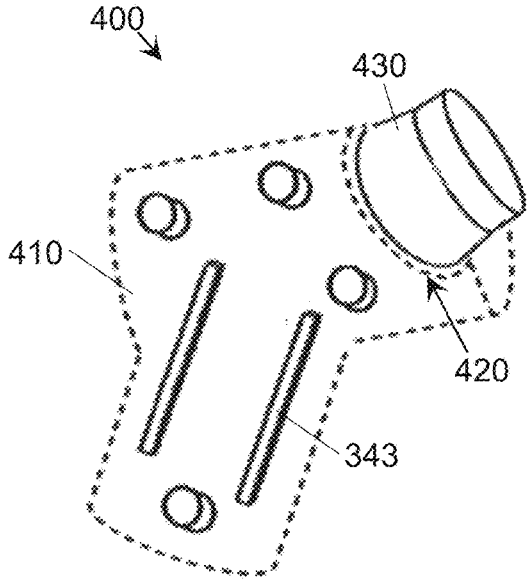
Figure 14:
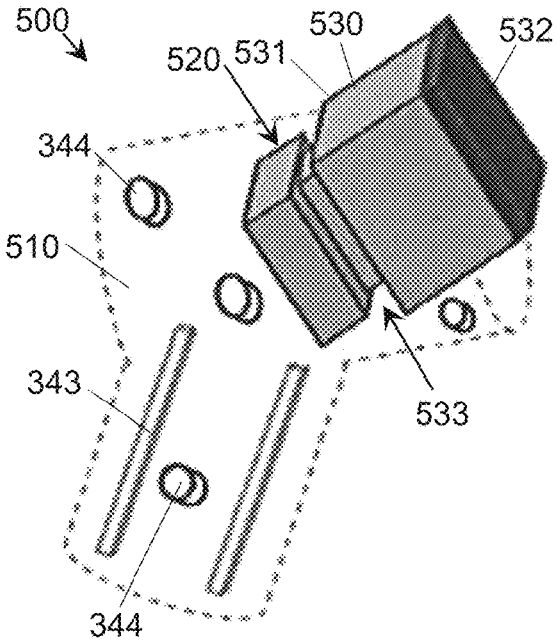

Referring now to FIGS. 12-14, embodiments of cutter element assemblies 300, 400, 500, 600 that can be used in place of cutter element assembly 200 previously described are shown. In FIGS. 12-14, the split pods are schematically shown with dashed lines, whereas the interlocking features of the split pods and the cutter elements are shown in solid lines.

Referring first to FIG. 12, cutter element assembly 300 is similar to cutter element assembly 200 previously described. In particular, cutter element assembly 300 includes a split pod 310 and a cutter element 330 captured and secured within a pocket 320 of split pod 310. Cutter element 330 includes a substrate 331 and a cutting layer 332 bonded to substrate 331. Substrate 331 and cutting layer 332 are the same as substrate 231 and cutting layer 232, respectively, as previously described with the exception that substrate 331 includes an annular recess 333. The two halves or sections forming split pod 310 are coupled together with interlocking structures comprising projections 343, 344 extending from the planar interface surface of one section and mating recesses extending from the planar interface surface of the other section. In this embodiment, projections 343 are elongate ribs and projections 344 are cylindrical pins. An annular flange extends into pocket 320 and is seated in mating recess 333. Half of the flange is defined by the first section of split pod 310 and the other half of the flange is defined by the second section of split pod 310. When sections of split pod 310 are secured together, cutter element 330 is captured and secured in pocket 320 with the flange seated in mating recess 333. Brazing may optionally be applied to secure cutter element 330 to pod 310 within pocket 320.

Referring next to FIG. 13, cutter element assembly 400 is similar to cutter element assembly 200 previously described. In particular, cutter element assembly 400 includes a split pod 410 and a cutter element 430 captured and secured within a pocket 420 of split pod 410. However, in this embodiment, cutter element 430 does not include a substrate. Rather, in this embodiment, cutter element 430 is entirely made of an ultrahard material such as polycrystalline diamond (e.g., the same material as cutting layer 232 previously described), polycrystalline cubic boron nitride (PCBN), or a slug formed from a hot pressed or sintered mixture of diamond and tungsten carbide particles. In the case of polycrystalline diamond forming cutter element 430, the polycrystalline diamond can be fully leached or polycrystalline diamond with a non-conventional catalyst such as $MgCO_3$. In this embodiment, the portion of cutter element 430 seated in pocket 420 has an outer surface that tapers or expands outwardly, thereby securing cutter element 430 within pocket 420 when the halves or section of split pod 410 are coupled together. The two sections forming split pod 410 are coupled together with interlocking structures comprising projections 343, 344 extending from the planar interface surface of one section and mating recesses extending from the planar interface surface of the other section. In this embodiment, projections 343, 344 are each as previously described. Brazing may optionally be applied to secure cutter element 430 to pod 410 within pocket 420.

Although cutter element 430 has an annular tapered outer surface, in other embodiments, the cutter element (e.g., cutter element 430) may have an outer surface with alternative geometries to secure it within the split pod (e.g., split pod 410). For example, in other embodiments the cutter element may have an annular recess similar to recess 333 previously described that mates with a flange along the inside of pocket 420 of split pod 410 or a reduced diameter cylindrical portion with an annular recess that mates with a flange along the inside of pocket 420 of split pod 410.

Referring next to FIG. 14, cutter element assembly 500 is similar to cutter element assembly 300 previously described. In particular, cutter element assembly 500 includes a split pod 510 and a cutter element 530 captured and secured within a pocket 520 of split pod 510. In addition, cutter element 530 comprises a substrate 531 and a cutting layer 532 bonded to substrate 531. Further, substrate 531 includes a recess 533 extending about the entire outer periphery of cutter element 530. However, in this embodiment, cutter element 530 has a rectangular prismatic geometry. Pocket 520 is sized and shaped to receive and mate with cutter element 530, and thus, pocket 520 also has a rectangular prismatic geometry. A flange extends into pocket 520 about the entire outer periphery of cutter element 530 and is seated in mating recess 533. Half of the flange is defined by the first section of split pod 510 and the other half of the flange is defined by the second section of split pod 510. When sections of split pod 510 are secured together, cutter element 530 is captured and secured in pocket 520 with the flange seated in mating recess 533. The two sections forming split pod 510 are coupled together with interlocking structures comprising projections 343, 344 extending from the planar interface surface of one section and mating recesses extending from the planar interface surface of the other section. In this embodiment, projections 343, 344 are each as previously described. Brazing may optionally be applied to secure cutter element 530 to pod 510 within pocket 520. Although cutter element 530 and pocket 520 have mating rectangular prismatic geometries, in other embodiments, the cutter element (e.g., cutter element 530) and mating pocket (e.g., pocket 520) may have other non-cylindrical mating geometries (e.g., triangular prismatic geometries).

Figure 15:
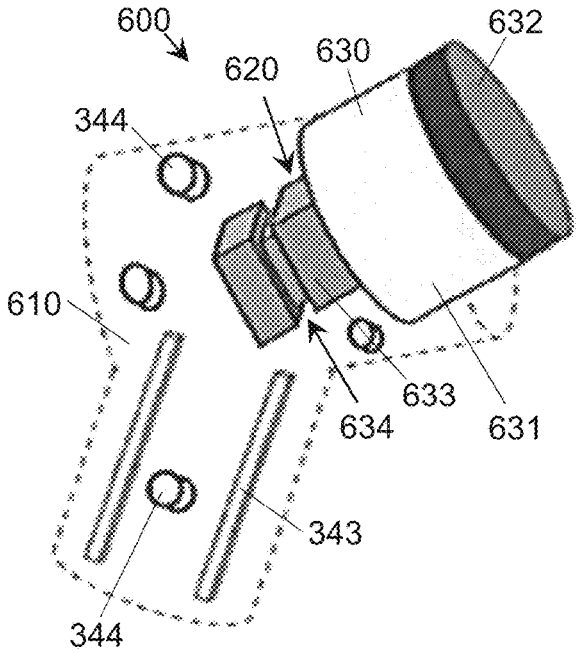

Referring next to FIG. 15, cutter element assembly 600 is similar to cutter element assembly 200 previously described. In particular, cutter element assembly 600 includes a split pod 610 and a cutter element 630 captured and secured within a pocket 620 of split pod 610. In addition, cutter element 630 comprises a substrate 631 and a cutting layer 632 bonded to substrate 631. However, in this embodiment, cylindrical substrate 631 includes a rectangular prismatic extension 633 including a recess 634 extending about the entire outer periphery of extension 633. Pocket 620 is sized and shaped to receive and mate with cutter element 630, and thus, pocket 620 also has a first section having a rectangular prismatic geometry that receives mating extension 633 and a second section having a cylindrical geometry that receives the remainder of substrate 631. A flange extends into the first section of pocket 620 about the entire outer periphery of extension 633 and is seated in mating recess 634. Half of the flange is defined by the first section of split pod 610 and the other half of the flange is defined by the second section of split pod 610. When sections of split pod 610 are secured together, cutter element 530 is captured and secured in pocket 520 with the flange seated in mating recess 634. The two sections forming split pod 610 are coupled together with interlocking structures comprising projections 343, 344 extending from the planar interface surface of one section and mating recesses extending from the planar interface surface of the other section. In this embodiment, projections 343, 344 are each as previously described. Brazing may optionally be applied to secure cutter element 630 to pod 610 within pocket 620. Although extension 633 and the first section of pocket 620 have mating rectangular prismatic geometries, in other embodiments, the extension (e.g., extension 633) and mating pocket (e.g., first section of pocket 620) may have other non-cylindrical mating geometries (e.g., triangular prismatic geometries, pentagonal prismatic geometries, hexagonal prismatic geometries, octagonal prismatic geometries, etc.). Such mating non-cylindrical geometries enable the discrete and precise rotational orientation of the cutter element (e.g., cutter element 630) relative to the pod (e.g., pod 610 to precisely define a particular region of the cutting face (e.g., cutting face 632) of the cutter element as the cutting tip. This is in contrast to conventional techniques of hand brazing cutter elements onto a blade of a drill bit by "eyeballing" the rotational orientation of the cutter element, which may not be particularly accurate or precise.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A modular fixed cutter drill bit for drilling an earthen formation, the drill bit having a central axis and a cutting direction of rotation about the central axis, the drill bit comprising:

a bit body configured to rotate about the central axis in the cutting direction of rotation, wherein the bit body includes a bit face;

a blade extending radially along the bit face, wherein the blade has a leading side relative to the cutting direction of rotation, a trailing side relative to the cutting direction of rotation, and a cutter-supporting surface extending from the leading side to the trailing side, wherein the blade includes a socket extending from the leading side of the blade and penetrating the cutter-supporting surface of the blade;

wherein the socket has a central axis, an open end at the leading side of the blade, and a closed end distal the leading side of the blade;

a cutter element assembly removably mounted to the blade and extending from the cutter-supporting surface of the blade, wherein the cutter element assembly comprises:

a pod seated in the socket and fixably attached to the blade, wherein the pod has a central axis, a leading end positioned outside the socket, and a trailing end positioned in the socket;

wherein the pod includes a pocket extending from the leading end;

a cutter element disposed in the pocket;

wherein the pod is a split pod comprising a first pod section and a second pod section that are removably attached together at an interface to secure the cutter element within the pocket, wherein the interface between the first pod section and the second pod section extends from the leading end of the pod.

2. The modular fixed cutter drill bit of claim 1, wherein the interface between the first pod section and the second pod section is disposed along a plane extending from the leading end of the pod to the trailing end of the pod.

3. The modular fixed cutter drill bit of claim 2, wherein the central axis of the pod is disposed in the plane.

4. The modular fixed cutter drill bit of claim 3, wherein the central axis of the socket is disposed in the plane.

5. The modular fixed cutter drill bit of claim 3, wherein the cutter element comprises a substrate and a cutting layer bonded to the substrate, and wherein the substrate has a central axis that is disposed in the plane.

6. The modular fixed cutter drill bit of claim 1, wherein each pod section includes a planar interface surface, wherein the planar interface surface of the first pod section faces and engages the planar interface surface of the second pod section along the interface between the first pod section and the second pod section.

7. The modular fixed cutter drill bit of claim 6, wherein the first pod section includes one or more projections extending from the planar interface surface of the first pod section and the second pod section includes one or more recesses extending from the planar interface surface of the second pod section;

wherein each projection of the first pod section is seated in one of the recesses of the second pod section.

8. The modular fixed cutter drill bit of claim 1, wherein the first pod section is bolted to the second pod section.

9. The modular fixed cutter drill bit of claim 1, further comprising:

a through bore extending from the cutter-supporting surface of the blade to the socket;

a counterbore extending into the pod; and a set screw extending from the through bore and into the counterbore of the pod, wherein the set screw is configured to prevent the cutter element assembly from being removed from the socket.

10. The modular fixed cutter drill bit of claim 1, wherein the pod includes a flange that partially closes the pocket at the leading end of the pod, and wherein the flange engages a cutting face of the cutter element.

11. A modular fixed cutter drill bit for drilling an earthen formation, the drill bit having a central axis and a cutting direction of rotation about the central axis, the drill bit comprising:

a bit body configured to rotate about the central axis in the cutting direction of rotation, wherein the bit body includes a bit face;

a blade extending radially along the bit face, wherein the blade has a leading side relative to the cutting direction of rotation, a trailing side relative to the cutting direction of rotation, and a cutter-supporting surface extending from the leading side to the trailing side, wherein the blade includes a socket extending from the leading side of the blade and penetrating the cutter-supporting surface of the blade;

wherein the socket mas a central axis, an open end at the leading side of the blade, and a closed end distal the leading side of the blade;

a cutter element assembly removably mounted to the blade and extending from the cutter-supporting surface of the blade, wherein the cutter element assembly comprises:

a pod seated in the socket and fixably attached to the blade wherein the pod has a central axis, a leading end positioned outside the socket, and a trailing end positioned in the socket;

wherein the pod comprises:

a pocket extending from the leading end;

a first section extending axially from the leading end of the pod, wherein the pocket is disposed in the first section;

a second section extending axially from the trailing end of the pod to the first section;

wherein the pocket has a central axis oriented at an acute angle relative to the central axis of the pod;

a cutter element disposed in the pocket;

wherein the pod is a split pod comprising a first pod section and a second pod section that are removably attached together to secure the cutter element within the pocket.

12. The modular fixed cutter drill bit of claim 11, wherein the pod comprises a convex shoulder at the intersection of the first section and the second section, wherein the convex shoulder of the pod is seated against a mating concave recess disposed along the socket.

13. The modular fixed cutter drill bit of claim 1, wherein the cutter element is secured within the pocket by an interference fit.

14. A modular fixed cutter drill bit for drilling an earthen formation, the drill bit having a central axis and a cutting direction of rotation about the central axis, the drill bit comprising:

a bit body configured to rotate about the central axis in the cutting direction of rotation, wherein the bit body includes a bit face;

a blade extending radially along the bit face, wherein the blade has a leading side relative to the cutting direction of rotation, a trailing side relative to the cutting direction of rotation, and a cutter-supporting surface extending from the leading side to the trailing side, wherein the blade includes a socket penetrating the cutter-supporting surface of the blade;

wherein the socket has a central axis, an open end at the leading side of the blade, and a closed end distal the leading side of the blade;

a cutter element assembly removably mounted to the blade and extending from the cutter-supporting surface of the blade, wherein the cutter element assembly comprises:

a pod seated in the socket and mechanically and removably attached to the blade, wherein the pod has a central axis, a first end positioned outside the socket, and a second end positioned in the socket;

wherein the pod includes a pocket extending from the first end, wherein the pocket has an open end at the first end of the pod, a closed end distal the open end, and a cylindrical surface extending from the open end;

a cutter element disposed in the pocket;

wherein the pod is a split pod comprising a first pod section and a second pod section that are removably attached together to capture the cutter element within the pocket, wherein the first pod section defines a first portion of the cylindrical surface of the pocket that engages the cutter element and the second pod section defines a second portion of the cylindrical surface of the pocket that engages the cutter element.

15. The modular fixed cutter drill bit of claim 14, wherein each pod section defines half of the pod.

16. The modular fixed cutter drill bit of claim 14, wherein each pod section includes a planar interface surface, wherein the planar interface surface of the first pod section faces and engages the planar interface surface of the second pod section.

17. The modular fixed cutter drill bit of claim 16, wherein the first pod section includes a projection extending from the planar interface surface of the first pod section and the second pod section includes a recess extending from the planar interface surface of the second pod section;

wherein the projection of the first pod section is seated in the recesses of the second pod section.

18. The modular fixed cutter drill bit of claim 17, wherein the first pod section is bolted to the second pod section.

19. The modular fixed cutter drill bit of claim 14, further comprising:

an internally threaded through bore extending from the cutter-supporting surface of the blade to the socket; and a set screw threadably engaging the internally threaded bore and extending into a recess disposed along an outer surface of the pod.

20. The modular fixed cutter drill bit of claim 14, wherein the cutter element is secured within the pocket by an interference fit.

* * * * *